US006119611A

United States Patent [19]

Tomita

[11] Patent Number: 6,119,611

[45] Date of Patent: Sep. 19, 2000

[54] SEWING MACHINE HAVING NONVOLATILE AND REWRITABLE STORING DEVICE

[75] Inventor: Shintaro Tomita, Nagoya, Japan

[73] Assignee: Brother Kogyo Kabushiki Kaisha, Nagoya, Japan

[21] Appl. No.: 09/458,098

[22] Filed: Dec. 10, 1999

[30] Foreign Application Priority Data

Dec. 17, 1998 [JP] Japan ..... 10-359142

[51] Int. Cl.[7] ..... D05B 19/12; D05C 5/04

[52] U.S. Cl. ..... 112/470.04; 112/102.5; 112/445; 700/138

[58] Field of Search ..... 112/470.01, 470.04, 112/102.5, 470.06, 445, 456, 458, 475.19; 700/138

[56] References Cited

U.S. PATENT DOCUMENTS 5,313,896 5/1994 Hashiride et al. ..... 112/103 X
5,657,708 8/1997 Okuno et al. ..... 112/102.5
5,778,808 7/1998 Hirata ..... 12/102.5

FOREIGN PATENT DOCUMENTS 5-146570 6/1993 Japan .
5-146572 6/1993 Japan .

*Primary Examiner*—Peter Nerbun
*Attorney, Agent, or Firm*—Oliff & Berridge, PLC

[57] ABSTRACT

A flash memory provided inside of a sewing machine stores display data in English only, a first language such as the language relating to operations for sewing and pattern selection and appearing on a display on the sewing machine. When a floppy disk exclusively for language changing, which stores display data developed for a plurality of other languages, such as Japanese, German, and French, is inserted into a floppy disk drive, and a language key, such as the Japanese language key, is pressed, the display data in Japanese only is read from the floppy disk, information currently stored in the flash memory is deleted, and then the read display data in Japanese is written into the flash memory. Therefore, according to the invention, the flash memory has a capacity enough to store display data for only one language, and can rewrite the language data of the display data to a desired language, which permits miniaturization of the flash memory and cost reduction.

20 Claims, 20 Drawing Sheets

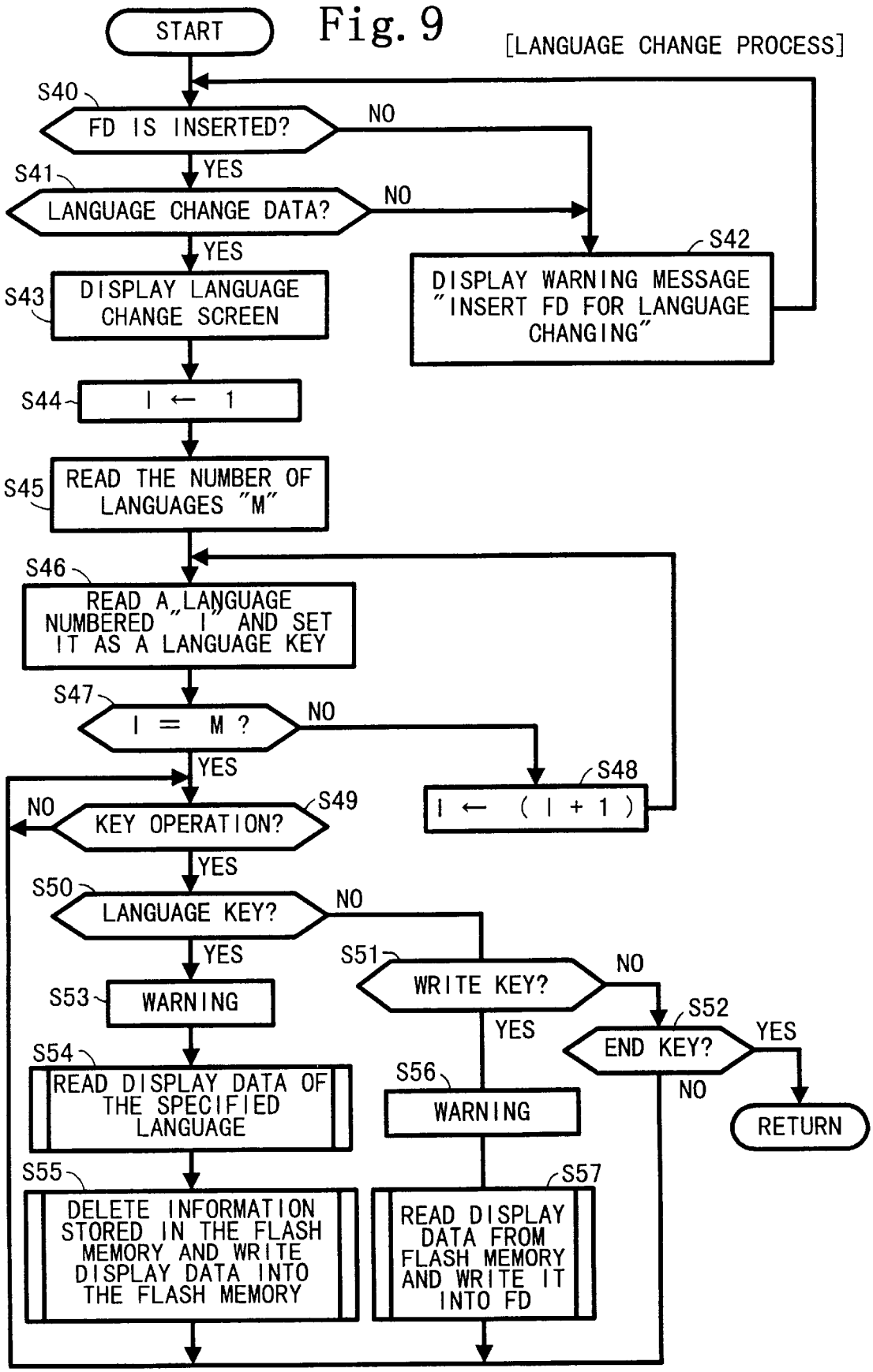
Fig. 9
[LANGUAGE CHANGE PROCESS]
START
S40
FD IS INSERTED?
NO
YES
S41
LANGUAGE CHANGE DATA?
NO
YES
S42
DISPLAY WARNING MESSAGE "INSERT FD FOR LANGUAGE CHANGING"
S43
DISPLAY LANGUAGE CHANGE SCREEN
S44
I ← 1
S45
READ THE NUMBER OF LANGUAGES "M"
S46
READ A LANGUAGE NUMBERED "I" AND SET IT AS A LANGUAGE KEY
S47
I = M ?
NO
YES
S48
I ← (I + 1)
S49
KEY OPERATION?
NO
YES
S50
LANGUAGE KEY?
NO
YES
S51
WRITE KEY?
NO
YES
S52
END KEY?
YES
NO
RETURN
S53
WARNING
S54
READ DISPLAY DATA OF THE SPECIFIED LANGUAGE
S55
DELETE INFORMATION STORED IN THE FLASH MEMORY AND WRITE DISPLAY DATA INTO THE FLASH MEMORY
S56
WARNING
S57
READ DISPLAY DATA FROM FLASH MEMORY AND WRITE IT INTO FD

SEWING MACHINE HAVING NONVOLATILE AND REWRITABLE STORING DEVICE

BACKGROUND OF THE INVENTION

1. Field of Invention

The invention relates to a sewing machine having a nonvolatile and rewritable storing device inside the sewing machine. The storing device stores display data including text and dot images to be shown on the display. The invention relates, in particular, to a sewing machine which reads display data of a desired language from a source outside of the sewing machine and writes the display data into the nonvolatile and rewritable storing device.

2. Description of Related Art

Conventionally, an electronic-controlled sewing machine for domestic use includes an embroidery frame driving mechanism that drives an embroidery frame in the two different directions which are at right angles to each other, and a display that shows not only utility stitch patterns, such as straight and zigzag. The display also shows embroidery patterns, such as an animal and a flower, one of which is selected using a pattern selection screen shown on the display. The selected pattern is sewn on a work cloth set in the embroidery frame with a plurality of colors if an embroidery pattern is selected.

Recent displays attached to sewing machines are more likely to be made larger so as to give operators information required for the machine operation, sewing efficiency, function selection, warning messages for operation mistakes, and using text and images on a large scale thereby providing for simple operation and efficient sewing.

Where the electronic-controlled sewing machines are exported to various countries such as the USA, France, Germany, and Holland, display data including the explanation text, warning messages, accompanying symbols and illustrations, which are indicated on the display, are of course different according to the exporting country, and are currently translated into 10 to 14 languages. Therefore, sewing machine manufacturers create display data in each language, and store a set of display data for all languages as a single unit in a nonvolatile memory like a ROM, which is provided in the control device. When a destination country is determined, its country name is specified so that the display data is shown in the language of the destination country.

This facilitates the change of language for display data if the destination country is suddenly changed, and errors regarding the change of language can be prevented.

In a sewing machine with an embroidery function, which is used in connection with a personal commuter (PC), not only sewing data for a plurality of embroidery patterns but also display data, created separately in a plurality of languages, is stored in the PC. The PC sends the sewing data and display data to the sewing machine to perform embroidering and indicate necessary information on the display of the sewing machine. That is, the operations are conducted on the PC side and sewing is performed on the sewing machine under an order from the PC. Sewing machines arranged this way have recently come into practical use.

As described above, in a conventional electronic-controlled sewing machine, the display data indicated on the display is developed into 10 to 14 languages, and 10 to 14 language versions of the display data are stored in a nonvolatile memory collectively, the storage capacity swelling to 30–35 MB. Accordingly, the control device and the sewing machine must be made larger, leading to higher manufacturing costs. Where a sewing machine is used in connection with a PC, it is impossible to change the display data on the sewing machine side when the PC is not connected.

SUMMARY OF THE INVENTION

The invention was made in consideration of the above circumstances. A first object of the invention is to obtain display data written in a desired language from an external device and store it in a nonvolatile storing device, thereby miniaturizing the storage capacity of the nonvolatile storing device. A second object of the invention is to simplify the change of display data into a different language. A third object of the invention is to make it possible to store display data in a language currently set in the nonvolatile storing device, in another storage medium, when changing the language for display data.

A sewing machine described in the embodiments of the invention to accomplish these objects, comprises a display that exhibits information, an obtaining device that obtains display data from outside of the sewing machine, a determining device that determines if the display data includes language change information, a nonvolatile storing device that stores the display data rewritably in a nonvolatile condition, a writing device that writes display data obtained by the obtaining device into the nonvolatile storing device when the determining device determines that the display data includes language change information, and a display controller that displays information on the display based on the display data stored in the nonvolatile storing device. If the display data in each language is included in an external storing device, such as a ROM card, a CD-ROM, or a floppy disk or on a communication network, such as the Internet, the determining device determines that the display data includes language change information. The obtaining device obtains display data in an appropriate language from outside of the sewing machine, and the writing device writes the display data into the nonvolatile storing device. The display controller displays information based on the display data stored in the nonvolatile storing device. Therefore, there is no need to provide a memory that can store display data developed for a plurality of languages inside the sewing machine. The display data in a language read from outside of the sewing machine can be indicated on the display as necessary. The nonvolatile storing device only needs to have a capacity to store the display data for one language. This can reduce the size of the storing device, leading to cost reductions.

In a preferred aspect of the invention, an external storing device that stores display data including language change information, is further included, wherein the obtaining device obtains display data from the external storing device. Because display data in each language is stored in the external storing device, such as a ROM card, a CD-ROM, or a floppy disk, it can be readily obtained from the external storing device and indicated on the display.

In another preferred aspect of the invention, the external storing device includes a language change identification data for identifying the language change information. Accordingly, the determining device can determine language change information in a short time only by referring to the language change identification data.

In a further preferred aspect of the invention, the obtaining device obtains display data through a communication network. Therefore, if the external storing device that stores display data, such as a ROM card or a CD-ROM, is not prepared, display data in the desired language can be obtained from a communication network, such as the Internet, and indicated on the display.

In another preferred aspect of the invention, a selecting device that selects at least one language of the display data to be obtained by the obtaining device is further included. Therefore, display data in a desired language can be indicated on the display as it is selected easily and surely by the selecting device.

In a further preferred aspect of the invention, the display controller displays a language name for display data stored in the nonvolatile storing device. Therefore, the language name displayed on the display allows an operator to recognize easily and surely what language is used for the currently set display data.

In another preferred aspect of the invention, an instructing device that instructs the obtaining device to obtain display data is included. Because the instructing device instructs the obtaining device to obtain display data only when it is necessary to change the language, there is no possibility of wrongly specifying the language for the display data, nor is there any need to waste time in obtaining unnecessary display data.

In a further preferred aspect of the invention, a transfer device that transfers the display data stored in the nonvolatile storing device to a predetermined storing device is also included. Before display data obtained from outside is written into the nonvolatile storing device, display data stored in the nonvolatile storing device can be transferred to a predetermined storing device. If the display data in the original language is required later, it can be easily rewritten from the specified storing device into the nonvolatile storing device. Therefore, display data in the original language can be restored simply and quickly.

In another preferred aspect of the invention, the display comprises a touch panel. Therefore, a user can do various kinds of operations only with the touch of the touch panel.

It is desirable to arrange that the touch panel has a key for specifying the transfer device and also indicates a language name for display data stored in the nonvolatile storing device. In such an arrangement, the language name currently set will be confirmed on the display and then the transfer can be ordered through the key, which can prevent errors regarding the change of language for display data.

In a further preferred aspect of the invention, the display controller displays a name of a thread color and/or a name of a stitch pattern in the language of the display data stored in the nonvolatile storing device. Therefore, the name of the thread color and/or the name of the stitch pattern can be displayed in the language to which changed.

In another preferred aspect of the invention, the obtaining device further obtains sewing data, and the writing device writes the sewing data as well as the display data into the nonvolatile storing device. Therefore, it is possible to make the most effective use of the obtaining device and the nonvolatile storing device as the display data and the sewing data can be obtained and stored into the nonvolatile storing device at the same time.

In a further preferred aspect of the invention, there is further provided the obtaining device that obtains a program, and the writing device writes the program as well as the display data into the nonvolatile storing device. Therefore, it is possible to make the most effective use of the obtaining device and the nonvolatile storing device because the display data and the program can be obtained and stored into the nonvolatile storing device at the same time.

In another embodiment of the invention, the sewing machine comprises an obtaining device that obtains data from outside of the sewing machine, a determining device that determines if the data is a program, a nonvolatile storing device that stores data rewritably in a nonvolatile condition, and a writing device that writes a program obtained by the obtaining device into the nonvolatile storing device when the determining device determines that the data is a program. Therefore, if a storing device, which is provided outside of the sewing machine, such as a ROM card, a CD-ROM, or a floppy disk, includes a program, the determining device determines that the program is included. The obtaining device obtains the program from the outside source, and the writing device stores the program into the nonvolatile storing device. Therefore, there is no need to use a personal computer, and it is possible to upgrade the program on the sewing machine easily.

In another preferred aspect of the invention, the obtaining device further obtains sewing data, and the writing device writes the sewing data as well as the program into the nonvolatile storing device. Therefore, the program and the sewing data can be upgraded at the same time.

In a further preferred aspect of the invention, the obtaining device further obtains language information, and the writing device writes the language information as well as the program into the nonvolatile storing device.

Therefore, it is possible to upgrade the program and change the language information at the same time.

BRIEF DESCRIPTION OF THE DRAWINGS

The invention will be described in greater detail with reference to preferred embodiments thereof and the accompanying drawings wherein:

FIG. 9 is a flowchart of a language changing control;

DETAILED DESCRIPTION OF PREFERRED EMBODIMENTS

Preferred embodiments of the invention will be described in detail with reference to the accompanying drawings.

The first embodiment of the invention is an example of the invention being applied to an electronically-controlled sewing machine that enables the sewing of not only utility stitch patterns but also various embroidery patterns by use of a detachable embroidery frame driving device.

Figure 1:
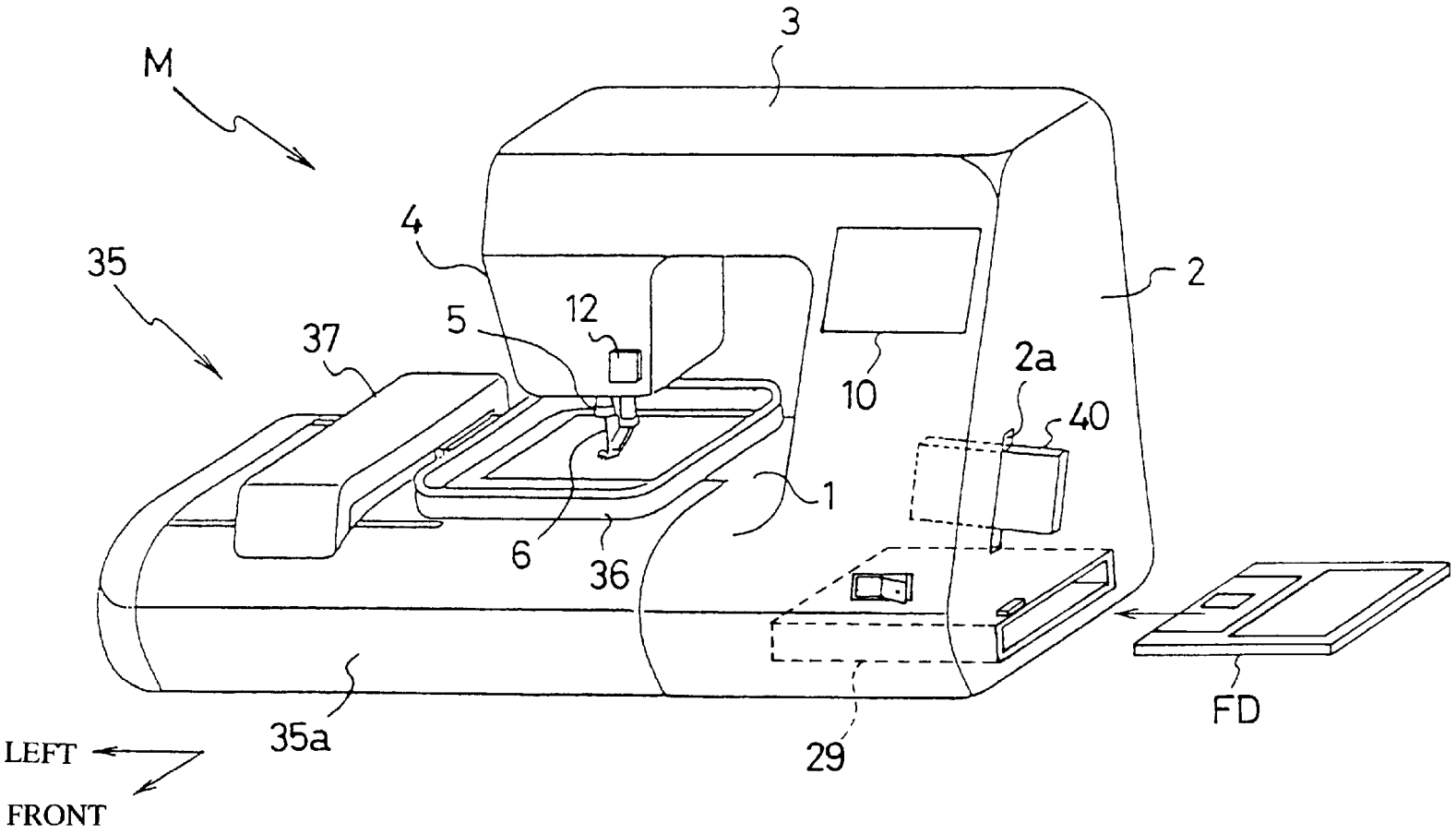
FIG. 1 is a perspective view of an electronically-controlled sewing machine of the invention.

The sewing machine M has, as shown in FIG. 1, a machine bed 1, a standard portion 2 that stands on the right of the bed 1, and an arm 3 extending from the upper part of the standard portion 2 toward the left in parallel with the bed 1.

The bed 1 includes a feed dog up and down moving mechanism (not shown) that moves a feed dog up and down, a feed dog back and forth moving mechanism (not shown) that moves the feed dog back and forth, and a thread loop taker (e.g. a vertical axis oscillating shuttle) that contains a lower thread bobbin and cooperates with a needle 6. On the side of the standard portion 2, there is a slot 2*a* into which a ROM card 40 having a large amount of pattern data can be inserted (sewing data and pattern display data) to be connected to an internal connector 13 (refer to FIG. 2). On the bottom of the standard portion 2 there is a floppy disk drive 29 for receiving a floppy disk (FD).

The arm 3 includes a needle bar driving mechanism (not shown) that moves a needle bar 5, having the needle 6 at the bottom, up and down, a needle bar swinging mechanism (not shown) that swings the needle bar 5 in the direction perpendicular to a feed direction of a work cloth, and a thread take-up driving mechanism (not shown) that moves a thread take-up in accordance with the up and down movement of the needle bar 5. The feed dog up and down moving mechanism, the needle bar driving mechanism, and the thread take-up driving mechanism are driven by a machine motor 17, the needle bar swinging mechanism is driven by a stepping motor 18 for swinging the needle bar 5, and the feed dog back and forth driving mechanism is driven by a stepping motor 19 for moving the feed dog back and forth (refer to FIG. 2). A machine head 4 in the arm 3 has a start/stop switch 12 that orders a start and an end of the sewing operation.

A large-sized color liquid crystal display 10 (LCD) is provided in front of the arm 3. The LCD 10 displays stitch types, pattern names, function names, and various messages assigned in utility stitch patterns and embroidery patterns. A plurality of touch keys 11, which are transparent electrodes and correspond to function names and pattern names, are arranged on a grid on the LCD 10. Thus, selection of a desired embroidery pattern or an order of a function can be realized simply by pressing a corresponding touch key 11.

On the left end of the bed 1, a free bed, generally known as a free arm, is formed where an embroidery frame driving mechanism 35 is detachably fixed. The embroidery frame driving mechanism 35 has a housing 35*a*, an embroidery frame 36 that can detachably hold a work cloth, a Y-axis direction driving part 37 including a Y-axis direction moving mechanism that moves the embroidery frame 36 in the Y-axis direction (back and forth), and an X-axis direction moving mechanism that is contained in the housing 35*a*. The X-axis direction moving mechanism is driven by a first stepping motor 38 and the Y-axis direction driving mechanism is driven by a second stepping motor 39 (refer to FIG. 2).

When the embroidery frame driving mechanism 35 is attached to the free bed, the first and second stepping motors 38, 39 are electrically connected to a controller C of the machine M via a connector 14. The controller C controls the operation of stepping motors 38, 39, and the embroidery frame 36, in which a work cloth is set, is moved in the X- and Y-axis directions individually to perform an embroidering operation.

Next, the control system of the electronically-controlled sewing machine M will now be described.

Figure 2:
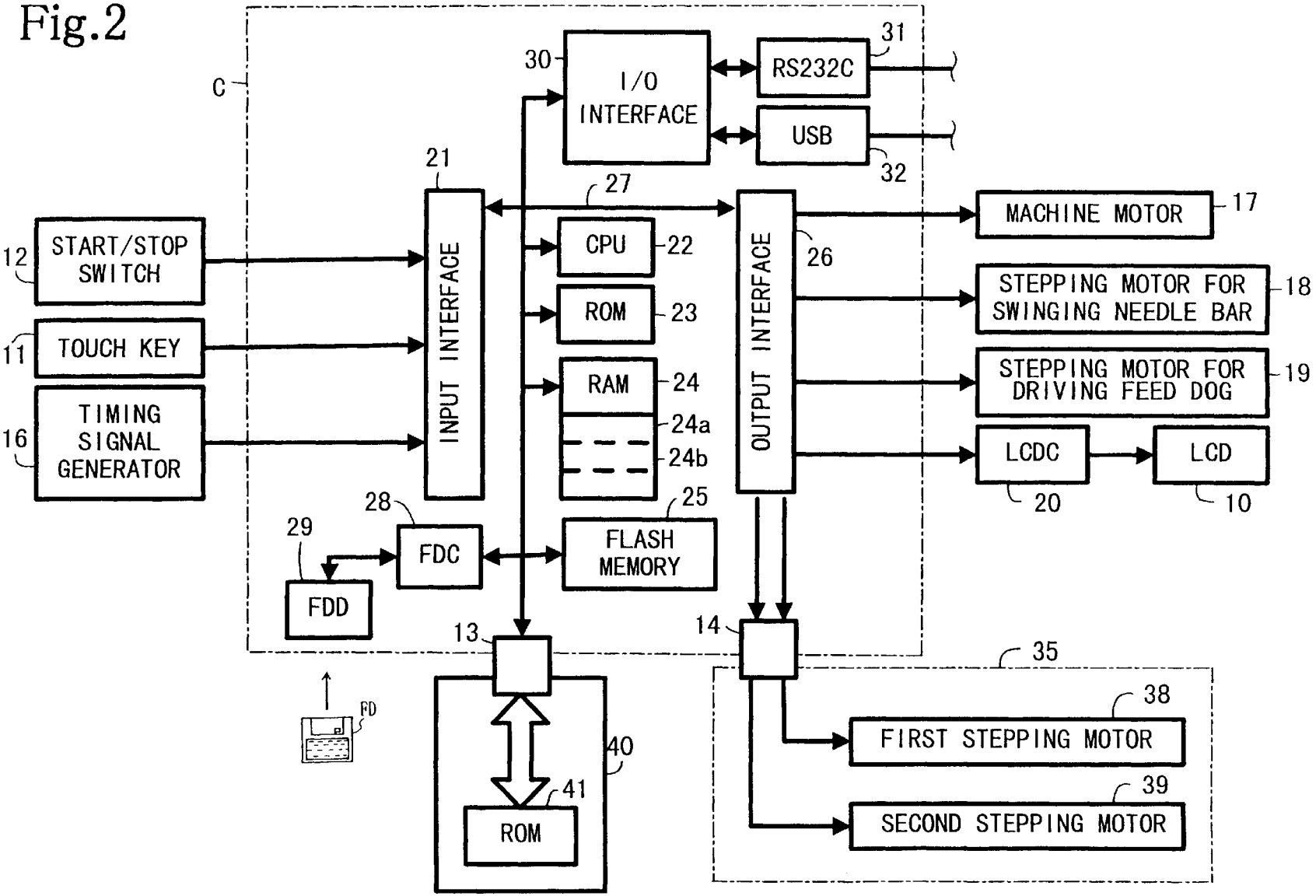
FIG. 2 is a control block diagram of the electronically-controlled sewing machine.

As shown in FIG. 2, the controller C comprises an input interface 21, a CPU 22, a ROM 23, a RAM 24, a flash memory 25 that is nonvolatile and electrically rewritable, a floppy disk controller (FDC) 28 that drives a floppy disk drive (FDD) 29, an output interface 26, and a data bus 27 that serves to connect the various elements. The input interface 21 is connected to the start/stop switch 12, the touch keys 11, and a timing signal generator 16 that detects a plurality of rotating phases of the sewing machine main shaft.

The output interface 26 is connected to motors 17, 18, 19, a display controller (LCDC) 20 for the LCD 10, and the first and second stepping motors 38, 39 for the embroidery frame driving mechanism 35 via the connector 14. The data bus 27 is connected to the ROM card 40 via the connector 13, and to the FDC 28 and an input/output interface 30. The input/output interface 30 is connected to an RS232C 31 that is an interface for communications to connect to a personal computer (not shown) and to a universal serial bus (USB) 32.

The ROM 23 has been prestored with general control programs for the sewing control required for sewing utility stitch patterns and display control, editing programs for editing a selected embroidery pattern by enlargement, reduction, and/or rotation via the LCD 10, an embroidering program for sewing a selected embroidery pattern, and a pattern selection program that is peculiar to the invention and will be described later.

Further, the ROM 23 stores font data for the alphabet in 10 pt (approx. 3.6 mm), 15 pt (approx. 5.4 mm), and 27 pt (approx. 10 mm) long to indicate text information, such as a pattern name, the number of stitches, and the number of colors. All font data are associated with alphabet code data.

Figure 3:
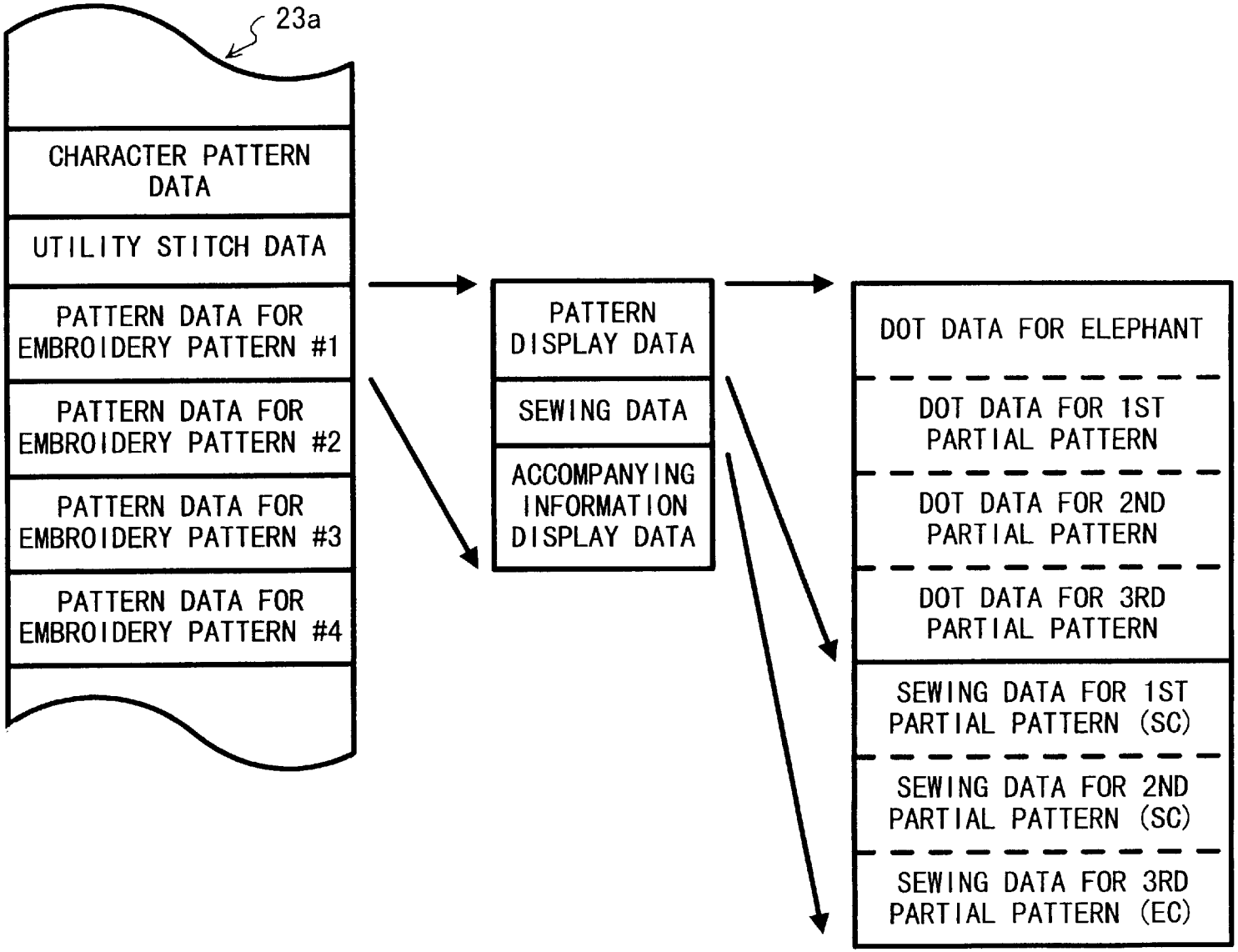
FIG. 3 shows a structure of data stored in a pattern data memory.

The pattern data memory 23*a* of the ROM 23, stores, as shown in FIG. 3, a plurality of pieces of pattern data. One piece is character pattern data related to letters, symbols and numerals; another piece is utility stitch pattern data including straight and zigzag stitches; and a further piece is embroidery pattern data which is often used relatively and divided into groups designated with numbers (like embroidery pattern No. 1, embroidery pattern No. 2, embroidery pattern No. 3). The pattern data have sewing data, display data, and accompanying information display data.

Figure 10:
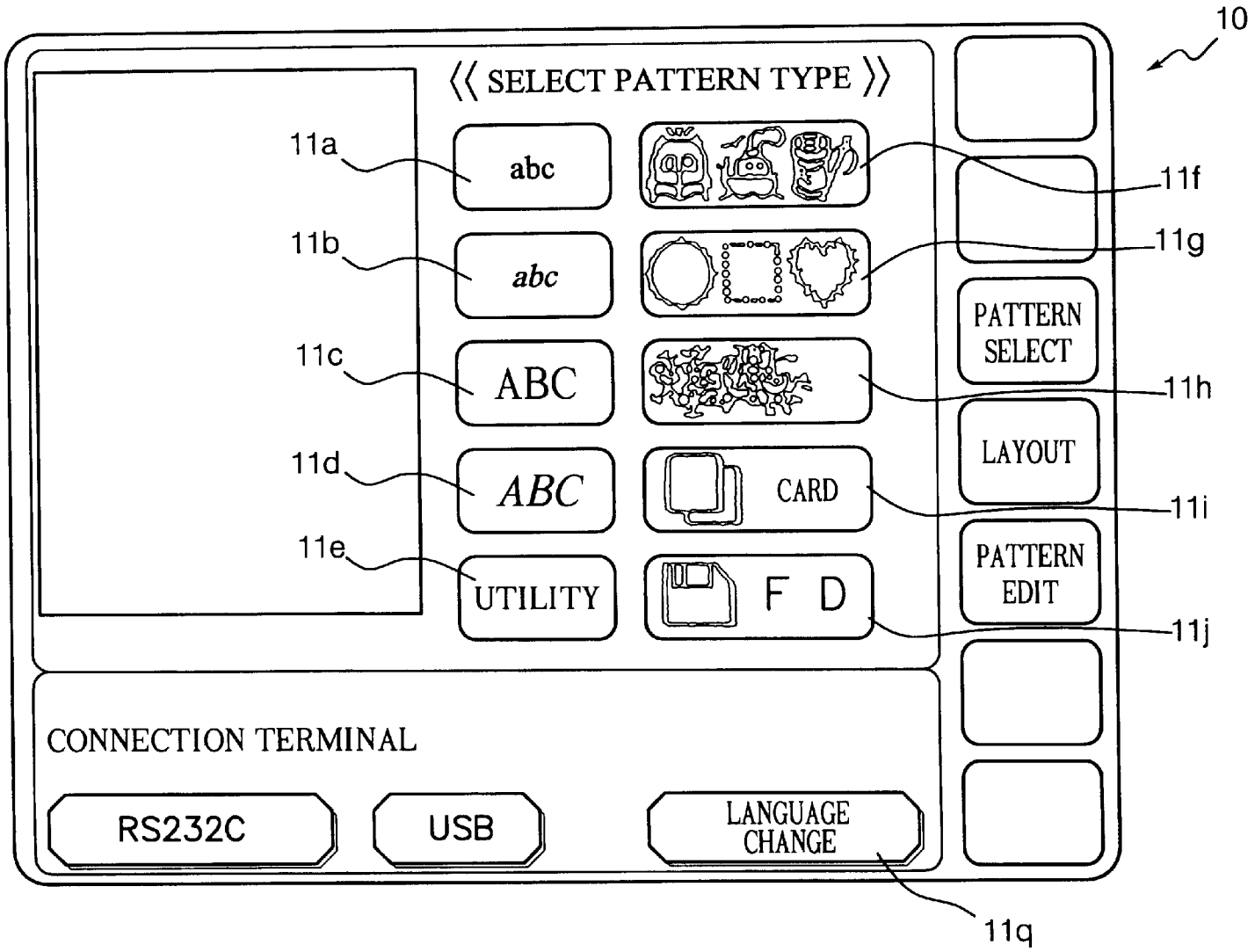
FIG. 10 shows an example of a menu screen.
Figure 13:
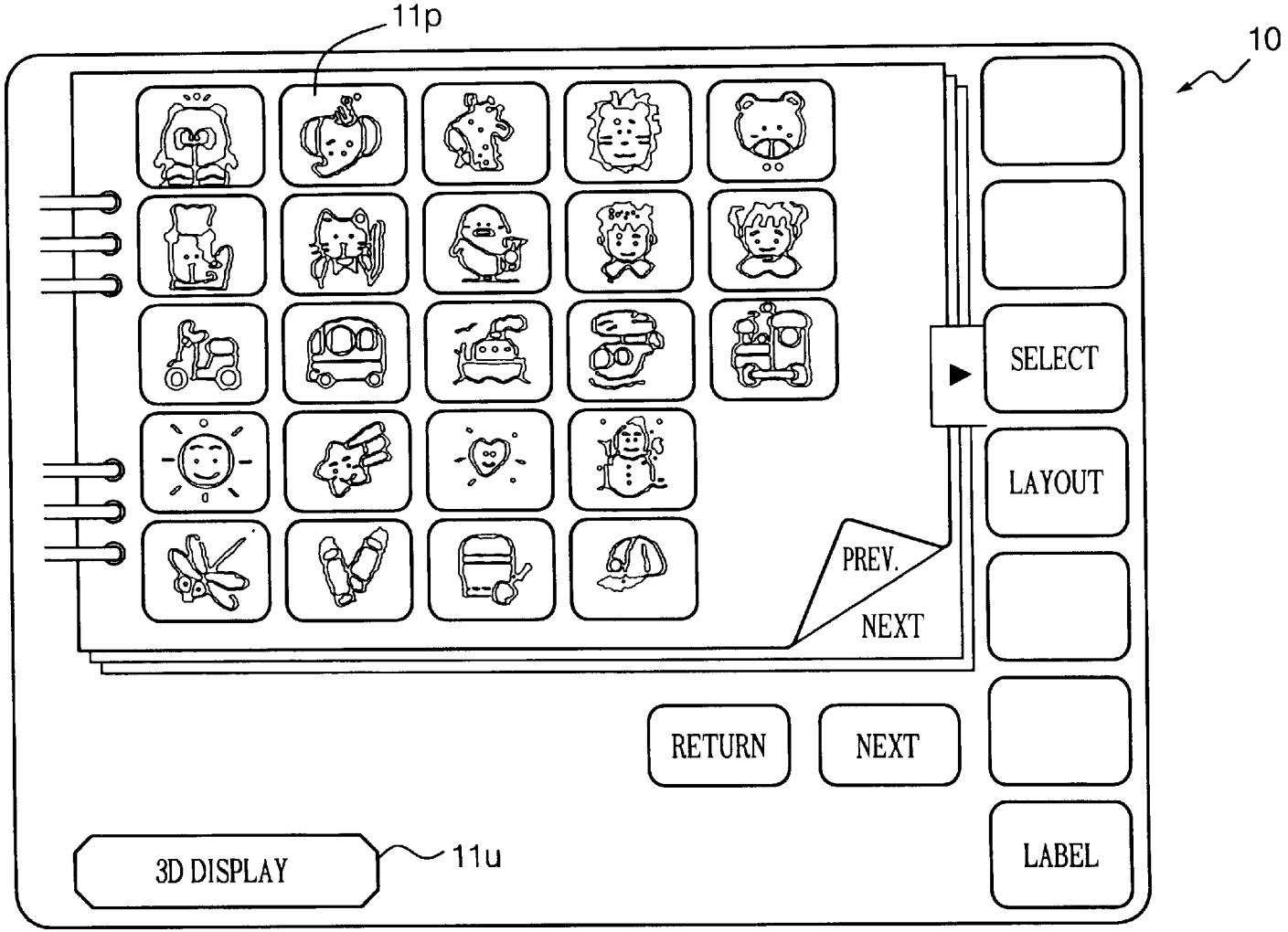
FIG. 13 shows a screen indicating embroidery patterns for selection.
Figure 14:
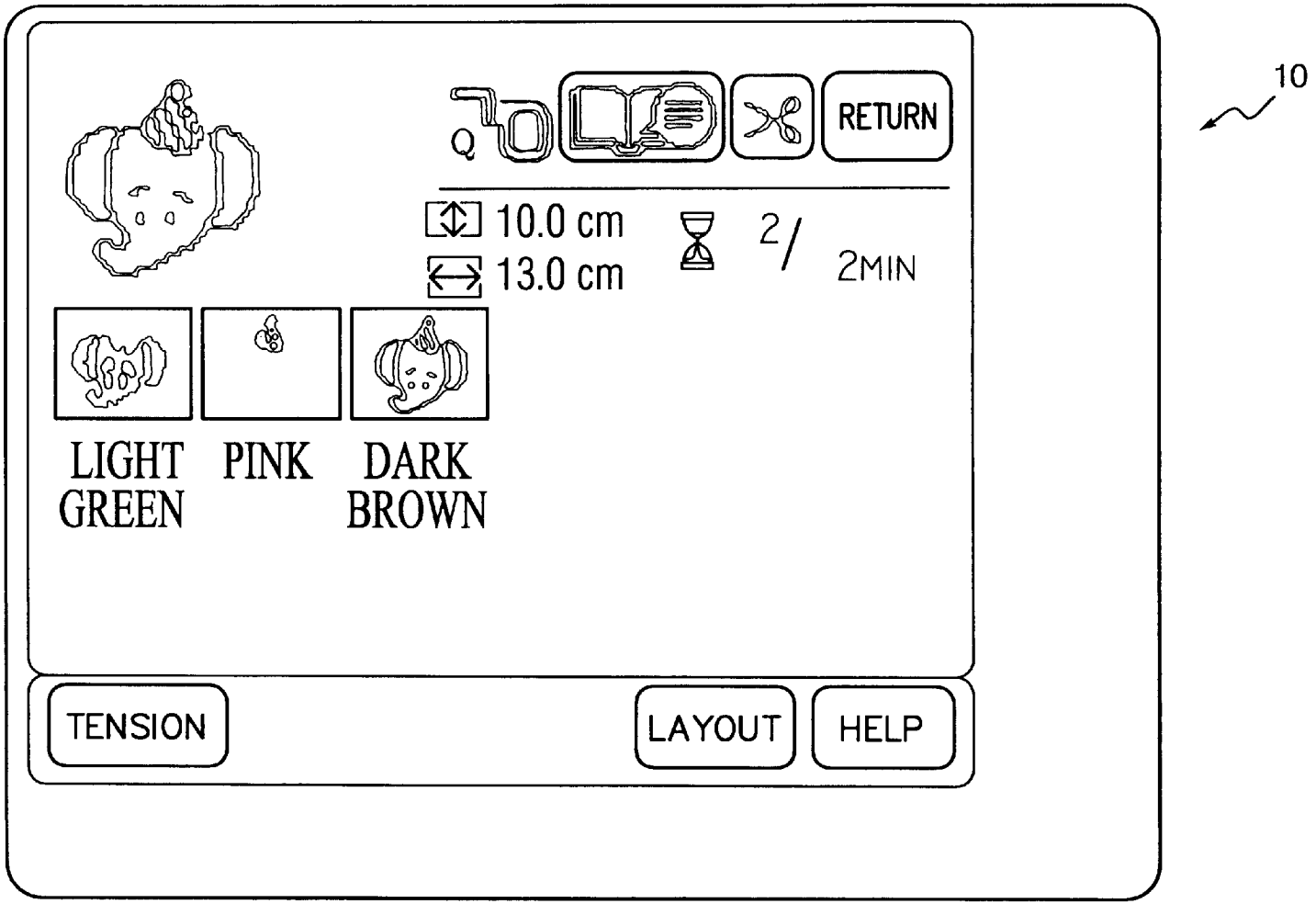
FIG. 14 shows a selected full embroidery pattern and partial patterns of the full pattern for indicating different colors.

Embroidery pattern data has the same composition as the other pattern data. For example, the data for embroidery pattern No. 1, as shown in FIG. 3, comprises pattern display data to display elements with a plurality of colors; sewing data required to perform embroidering; accompanying information display data including display data used for pattern selection, as shown in FIGS. 10 and 13, and display indicating information that indicates text (character strings), numbers, and function keys at designated positions on the display, except for a selected embroidery pattern and partial patterns, as shown in FIG. 14. All data is stored distinctively.

For example, embroidery pattern No. 1 is an elephant pattern as shown in FIG. 14. The elephant pattern has its original full pattern and three partial patterns for embroidering different colors. To display them on the LCD 10, their respective dot data are stored. The sewing data of the elephant pattern comprises three pieces of sewing data for three partial patterns, each of which is sewn with one of the three different colors. The accompanying information display data of the elephant pattern includes the display position data that determine where the elephant pattern, three partial patterns, color name "Light Green" for text #1, color name "Pink" for text #2, color name "Dark Brown" for text #3, are displayed.

The display position data further includes "18.0 cm" for text 4, "13.0 cm" for text 5, a mark for presser foot Q, a mark for scissors, and function keys like "RETURN," and "TENSION." The sewing data for each partial pattern has stop code (SC) for thread change, and a sewing time. The sewing data for the last partial pattern includes end code (EC) in addition.

The ROM card 40 has a plurality of versions according to the pattern type. As with the ROM 23, the ROM 41 of the ROM card 40 stores a plurality of pieces of embroidery pattern data with a low frequency of use so that they are divided into groups using numbers (Refer to FIG. 3.).

In the RAM 24, a pattern name memory 24*a* stores a plurality of pattern names read from a FD. A sewing data memory 24*b* stores sewing data for a selected embroidery pattern. Further, the RAM 24 includes memories required for each control required to accomplish what is described above (e.g., flag memory, pointer memory, counter memory, register, buffer).

Figure 4:
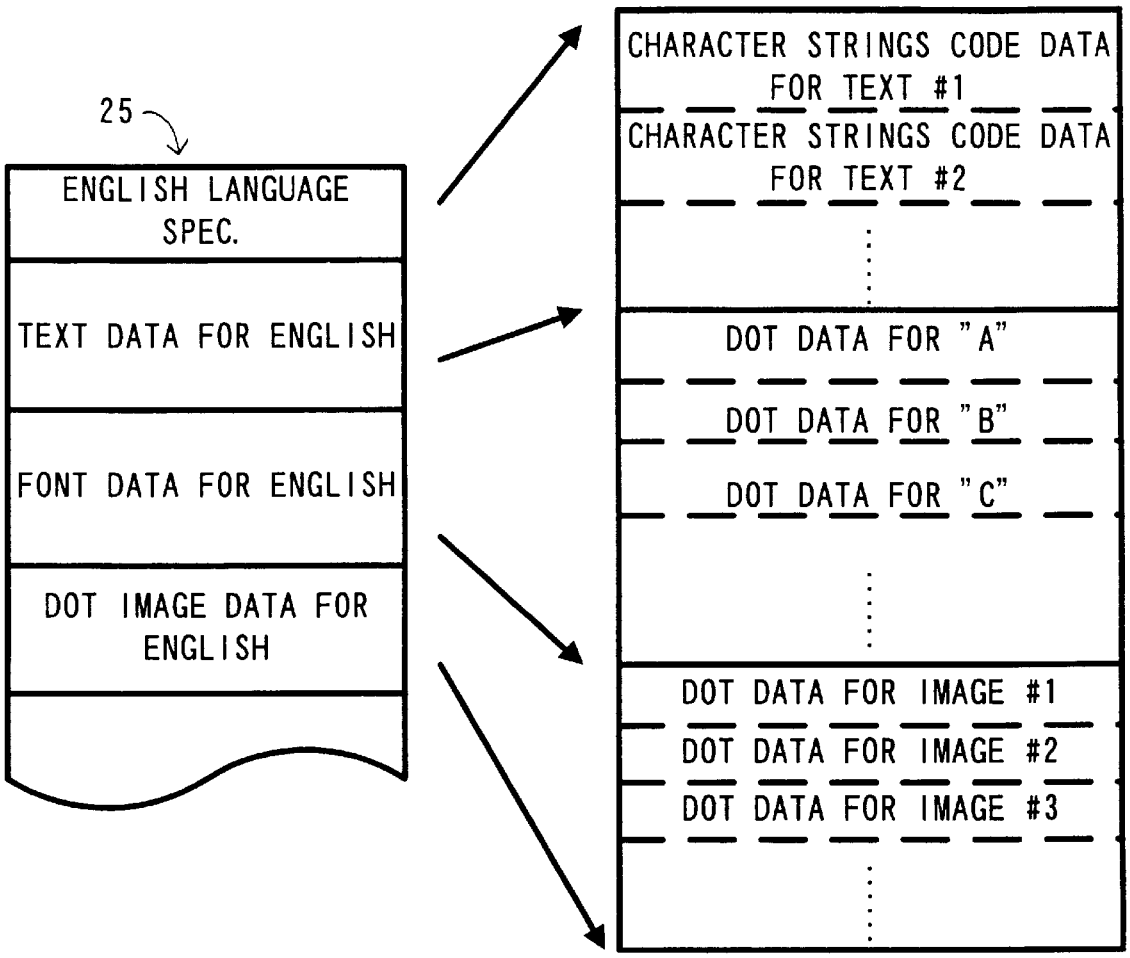
FIG. 4 shows a structure of data stored in a flash memory that stores display data in English.

The flash memory 25 rewritably stores information on what language specification has been currently set, e.g. English, text data written in the language, font data used for the language, and image data for the language as shown in FIG. 4.

The text data includes code data for various character strings, such as "Light Green" assigned to text 1 and "Pink" to text 2, as described above. The font data has dot data for character fonts of letters, symbols and numerals. The image data has dot data for images, such as "presser foot type Q" as image 1, and "scissors" as image 2, as shown in FIG. 14 for example.

Figure 5:
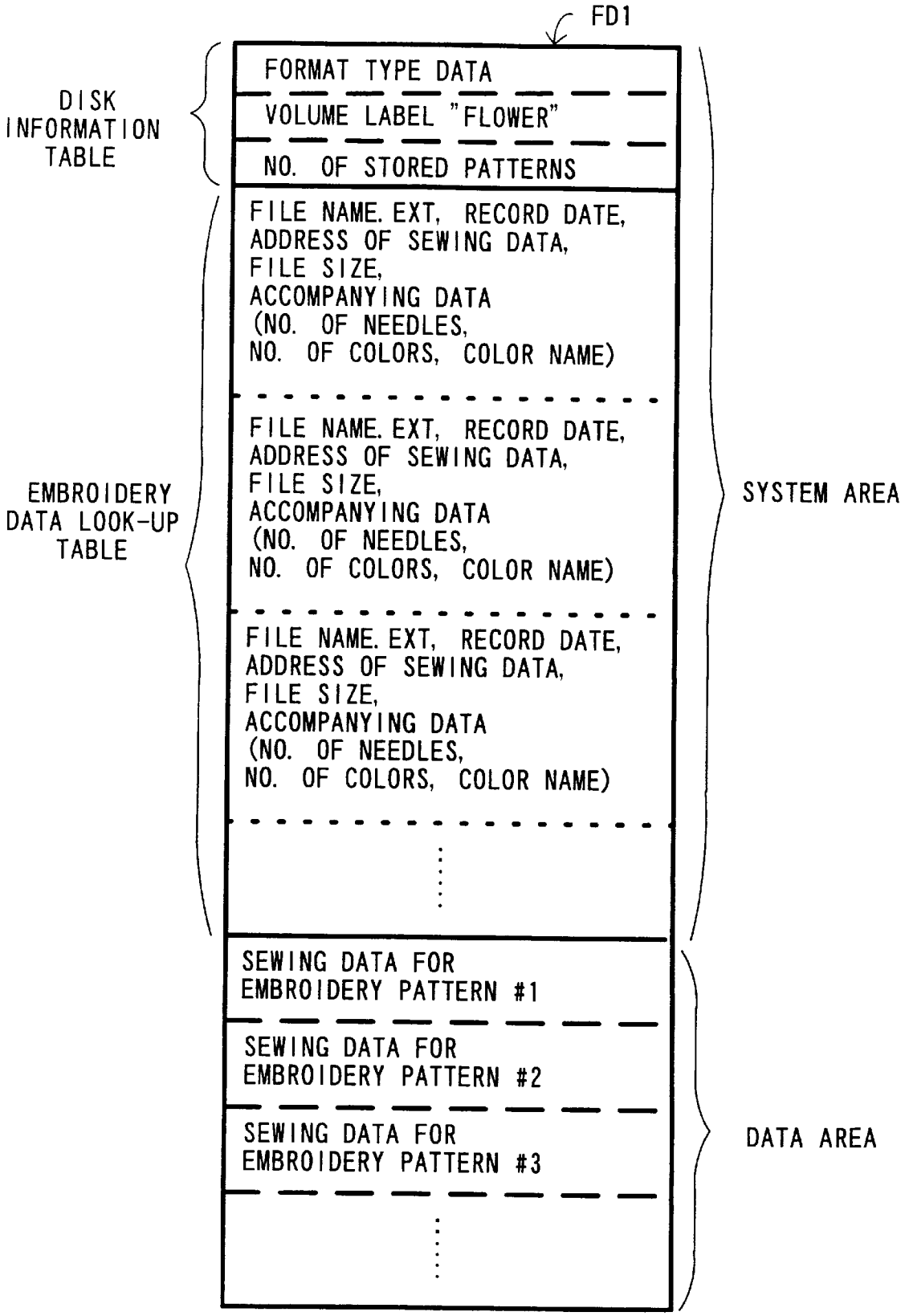
FIG. 5 shows a structure of data stored in a floppy disk exclusive for embroidery patterns.

A floppy disk FD 1 for storing embroidery patterns includes various data in addition to sewing data for stitch formation. As shown in FIG. 5, the floppy disk FD1 an be divided into two areas, a system area and a data area.

In the system area, a disk information table and a plurality of embroidery data look-up tables are stored. The disk information table includes format type data that defines the FD format, such as 2DD or 2HD, a volume label, e.g. "FLOWER", and the number of patterns stored, e.g. "22". In addition, each embroidery data look-up table includes a filename having a pattern name and an extension, a recording date, an address for embroidery data stored in the data area, a file length, and accompanying data related to stitch formation. An extension like ".HUS" and ".PES" is attached to the end of a filename to indicate the type of file.

The accompanying data has information about the number of stitches to be sewn, the number of colors to be used, and color names for corresponding colors.

The data area includes sewing data required to form each embroidery pattern starting from the top address indicated by the sewing data storage address. If the sewing data is used to embroider a pattern with a plurality of colors, it includes stop codes that stop the needle for every color change.

Figure 6:
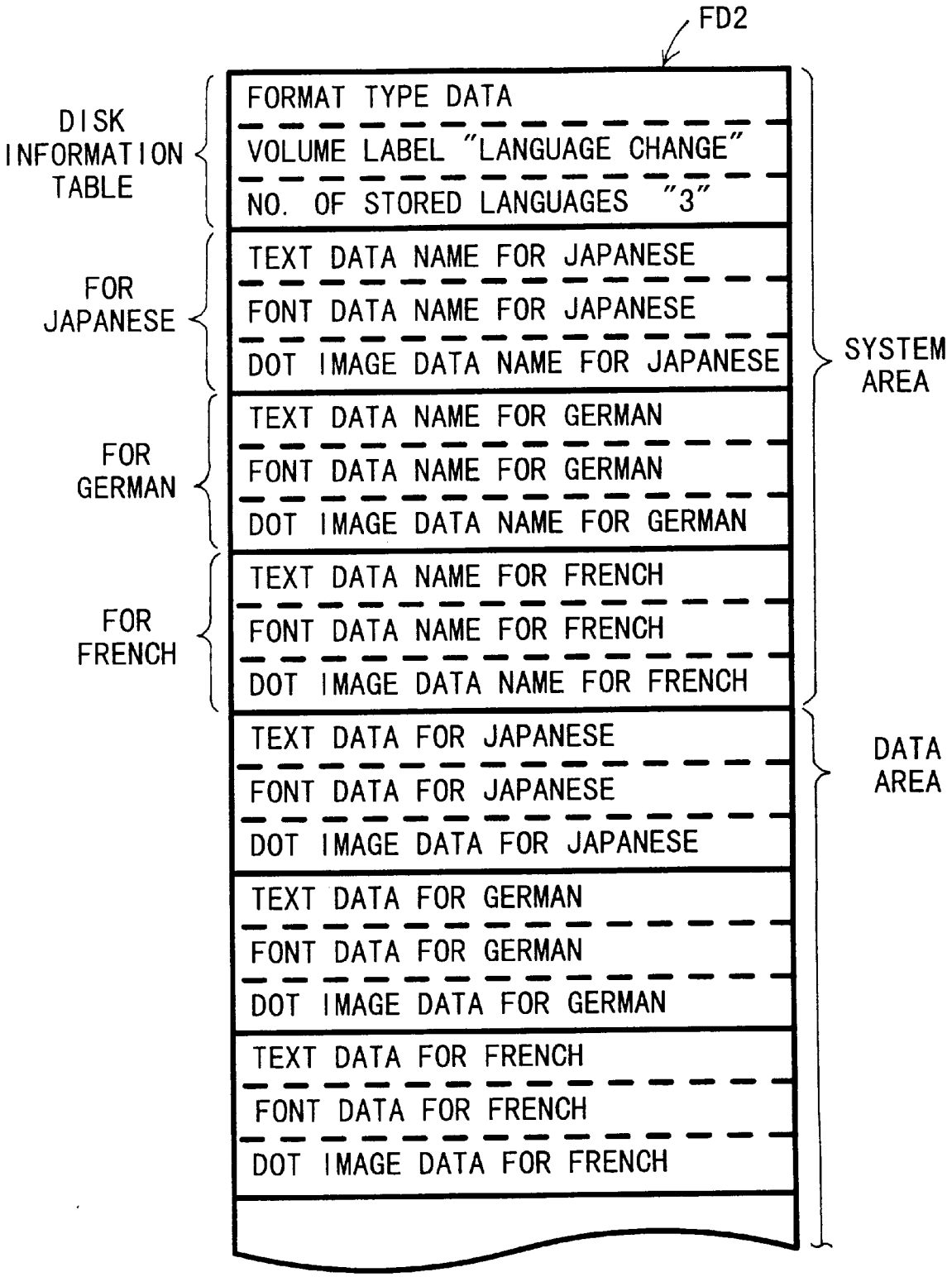
FIG. 6 shows a structure of data stored in a floppy disk exclusive for language changing.

A floppy disk FD2 is used for changing languages to set the display data in another language. As shown in FIG. 6, it can be divided into two areas, a system area and a data area.

The system area of the FD2 stores disk information data, such as format type data that defines the FD format, a volume label, e.g. "LANGUAGE CHANGE", the number of languages stored, e.g. "3", and language data which can be changed to another language, e.g., Japanese, French, and German, in this example, including text data name, font data name, and image data name for each language.

On the other hand, the data area stores text data, font data, and image data for each language, which are associated with the numbers.

Figure 7:
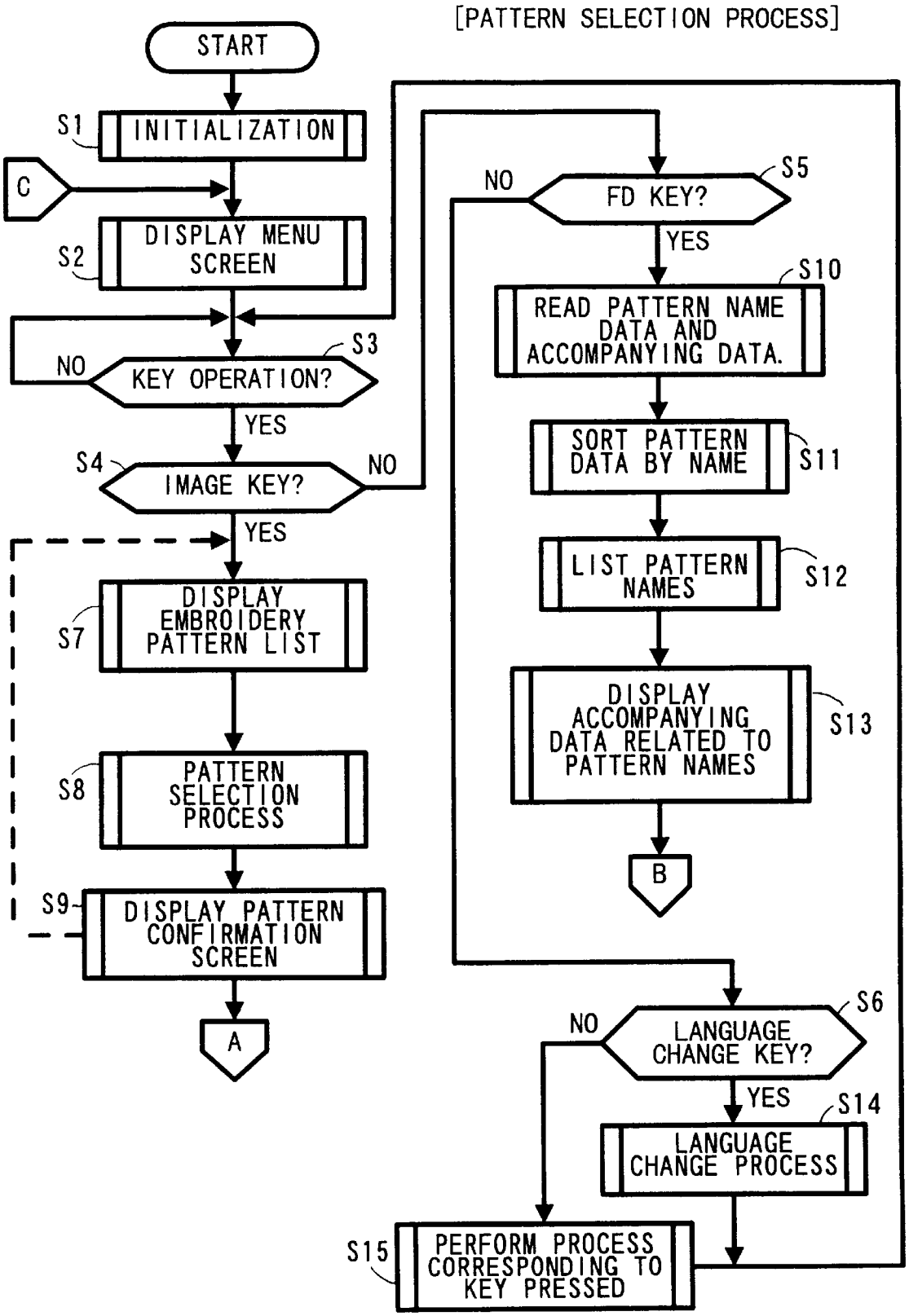
FIG. 7 is a part of a flowchart of a pattern selection control.
Figure 8:
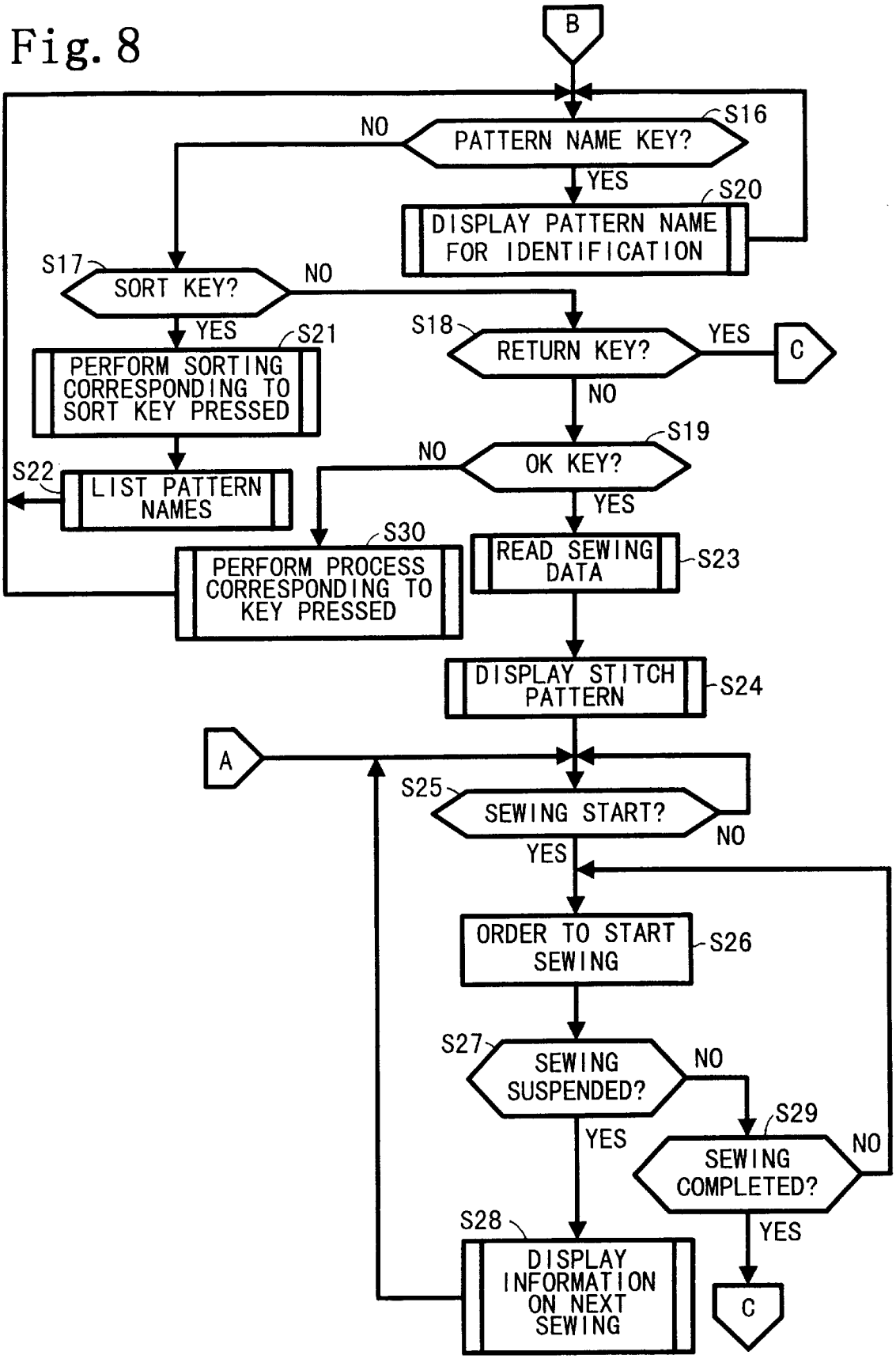
FIG. 8 is a remaining part of the flowchart of the pattern selection control.

Next is an explanation about routines for the pattern selection control executed in the controller C with reference to the flowcharts of FIGS. 7, 8 and 9. In the flowcharts, Si (i=1, 2, . . . ) stands for a procedure step.

When the power is turned on and the pattern selection control is started, initialization, such as clearing each memory in the RAM 24, is performed (S1), and a menu screen where a pattern type is specified appears on the LCD 10 (S2).

For example, as shown in FIG. 10, the menu screen includes character specification keys 11*a*, 11*b*, 11*c*, and 11*d* used for specifying character patterns, such as letters, symbols and numerals, a utility stitch key 11*e* for selecting a utility stitch pattern, image keys 11*f*, 11*g*, 11*h* for selecting image patterns, a card key 11*i* for selecting an embroidery pattern stored in the ROM card 40 inserted into the machine M, and a FD key 11*j* for selecting an embroidery pattern stored in the FD1 inserted into the machine M.

To select an embroidery pattern stored in the FD1 inserted in the FDD 29, the FD key 11*j* is pressed (S3: Yes, S4: No, S5: Yes), and then pattern name and accompanying data are read from the FD1 and written into the pattern name memory 24*a*(S10).

Figure 11:
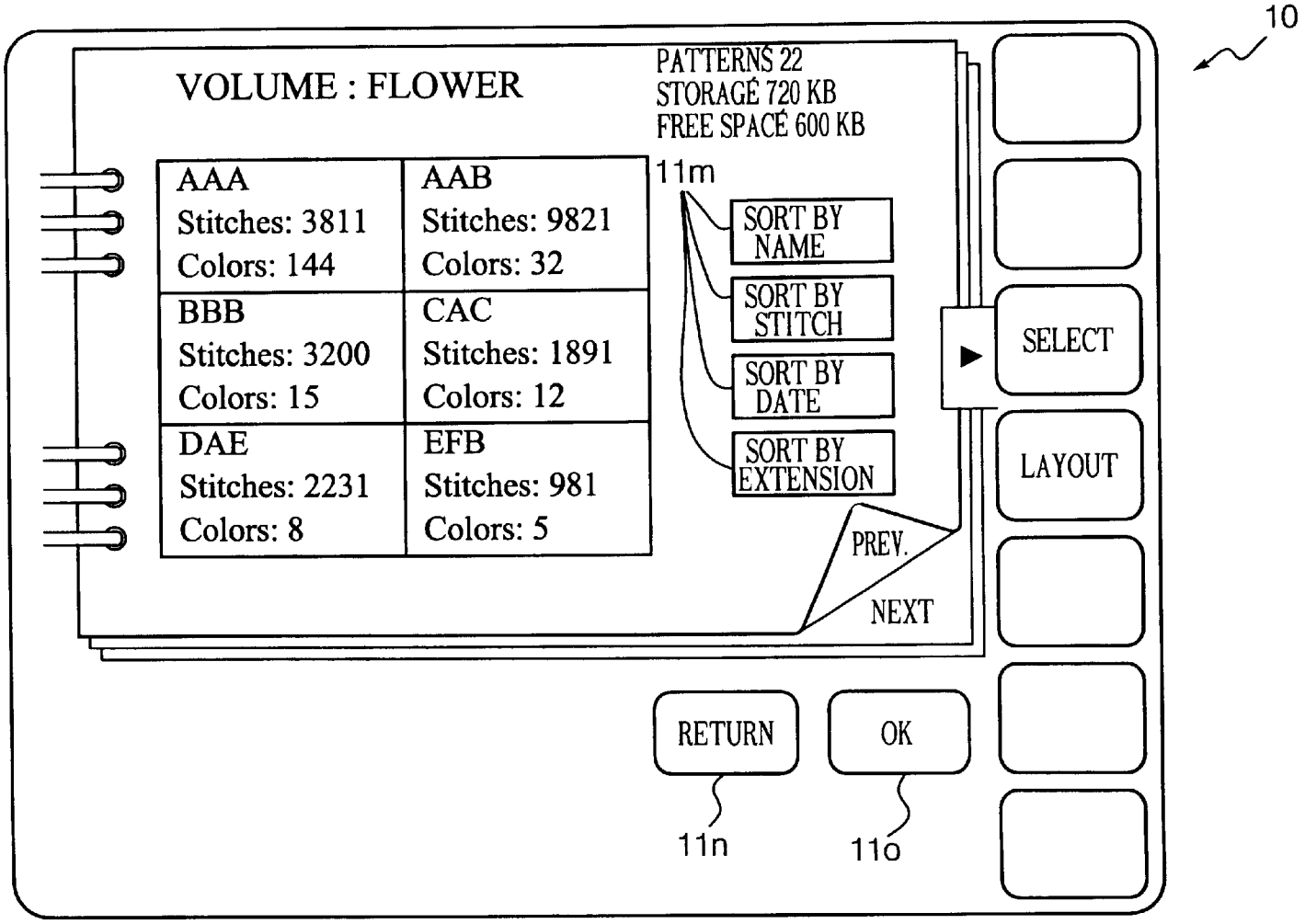
FIG. 11 shows an example of a pattern name display screen.

A plurality of pattern names stored in the pattern name memory 24*a* are sorted alphabetically, and the sorted pattern names are renewedly stored in the pattern name memory 24*a*(S11). The LCD 10 lists the pattern names arranged alphabetically (S12), then shows accompanying data related to the pattern names (S13). For example, FIG. 11 shows a display on the LCD 10 of the pattern names which are sorted alphabetically from the top of the patterns stored in the FD1, like AAA, AAB, BBB, in the two columns with 15 pt screen fonts.

Under each pattern name, the number of stitches and the number of colors are indicated. In addition, function names, such as sorting by the number of stitches or pattern name, "RETURN" and "OK", are indicated. The pattern names that are in the hatched areas where lines are slanted to the right, such as "AAA", "CAC", and "DEA" are covered with one color, such as blue, and the pattern names that are in the hatched areas where lines are slanted to the left are covered with another color, such as green. The pattern names in the hatched areas function work as pattern name keys.

When a pattern name key 11*k* for a desired pattern name is pressed (S16: Yes), the pattern name corresponding to the pattern name key 11*k* pressed is highlighted for identification (S20).

Figure 12:
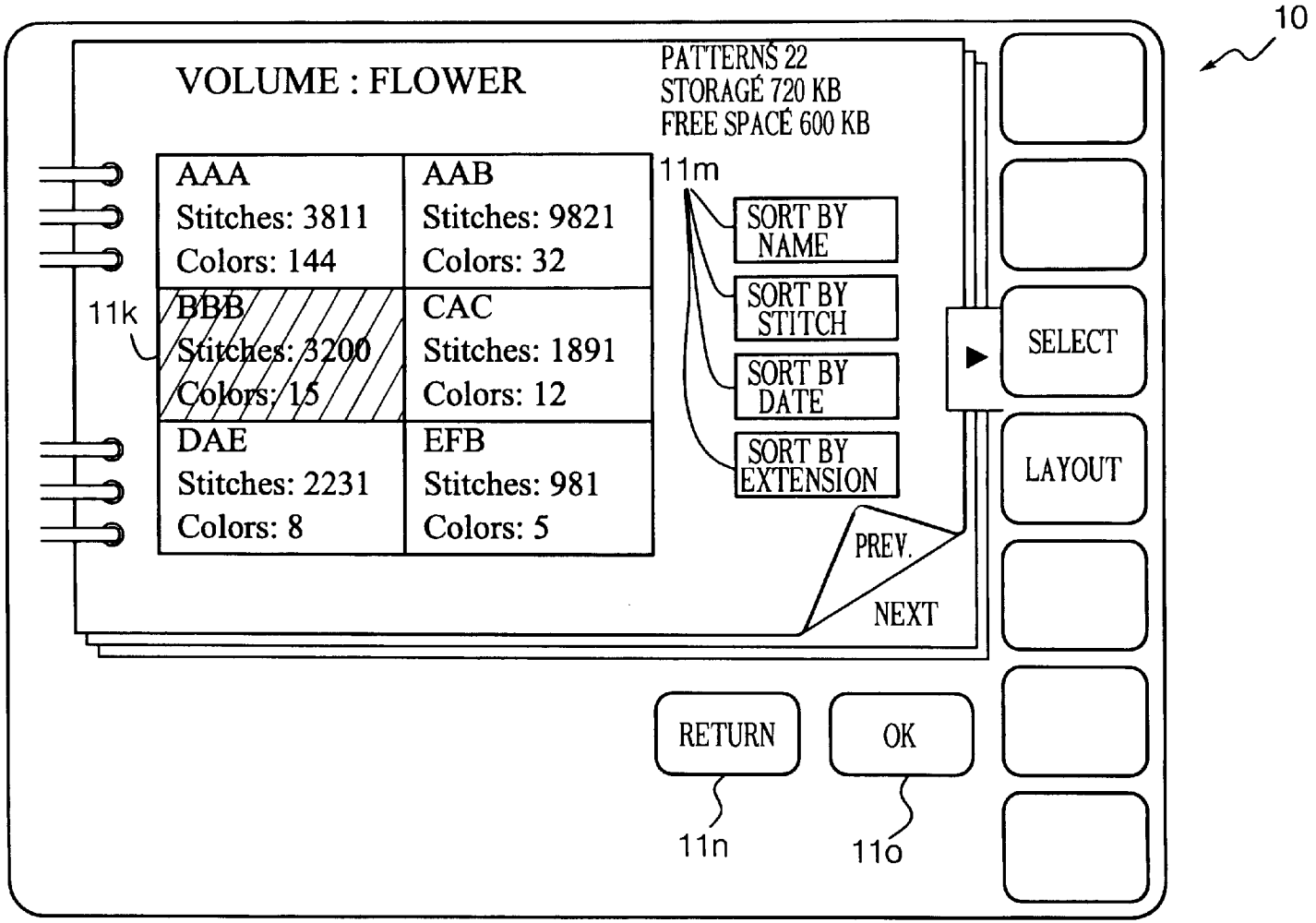
FIG. 12 corresponds to FIG. 11 when a pattern is selected.

For example, FIG. 12 shows that pattern name "BBB" is selected and indicated in highlight on a colored background when the pattern name key 11*k* is pressed. Instead, the pattern name whose key is pressed may be indicated with a vivid color like red or displayed so that it blinks. When a sort key 11*m*, such as "sort by name" key and "sort by the number of stitches" key is pressed (S16: No, S17: Yes), the sorting corresponding to the sort key pressed is performed (S21), and sorted pattern names are indicated in a table on the LCD 10 (S22).

When the "RETURN" key 11*n* is pressed (S16 and S17: No, S18: Yes), steps on and after S2 are executed. When the "OK" key is pressed (S16–S18: No, S19: Yes), the pattern selection for the pattern name highlighted for identification is fixed, and its sewing data is read from the FD1 and stored in the sewing data memory 24*b* (S23), and the stitch pattern calculated based on the sewing data appears on the LCD 10 (S24). When another function key, such as a "previous page" key or a "next page" key is pressed (S16–S19: No), the corresponding processing is performed (S30).

When the start/stop switch 12 is pressed to start sewing (S25: Yes), the command to start sewing is issued (S26). As a result, the sewing control functions, each single stitch data is successively read from the sewing data memory 24*b*(S26, S27, and S29: No), and sewing is performed (S26, S27, and S29: No). If sewing is stopped partway through the pattern, due to thread breakage or operation of the start/stop switch 12, or sewing is temporarily suspended due to stop code SC for a thread color change (S27: Yes), sewing information for the next thread color like "second (third) color is to be sewn" appears on the LCD 10 (S28).

When sewing of the entire pattern is completed (S27: No, S29: Yes), steps on and after S2 are repeatedly performed.

On the other hand, if an image key 11*f* for a desired pattern category, such as animals and vehicles, is pressed on the menu screen to select a desired image (S3 and S4: Yes), a lot of icons representing animals and vehicles are displayed (S7) as shown in FIG. 13. For example, when a pattern key 11*p* is pressed to select an elephant pattern (S8), the LCD 10 shows a pattern selection confirmation screen having the complete image of the elephant pattern and three partial images of the elephant pattern for colors, as shown in FIG. 14 (or FIG. 18 if the language is Japanese) (S9).

When the "RETURN" key is pressed on the pattern selection confirmation screen, the flow returns to S7, then steps S25–S29 are performed to embroider the three patterns for the partial images with the three different colors. In this case, the appropriate partial image is moved to the forefront in order at step S28 every time embroidering of a partial pattern is completed and stopped temporarily to start the next partial pattern (S27: Yes).

When the language change key 11*q* is pressed to indicate displaying the display data in another language (S3: Yes, S4 and S5: No, S6: Yes), the language change control (refer to FIG. 9) is performed (S14).

When the language change control is started, and if no floppy disk is inserted into the FDD 29 (S40: No) or a floppy disk inserted into the FDD29 does not have a volume label of language changing and the floppy disk is not FD2 (S41: No), the LCD 10 shows a warning message indicating a requirement to insert a FD for language changing (S42). However, if the volume label is for language changing and the FD2, which is used for regular language changing, is inserted into the FDD 29 (S40 and S41: Yes), a language changing screen appears on the LCD (S43).

Figure 15:
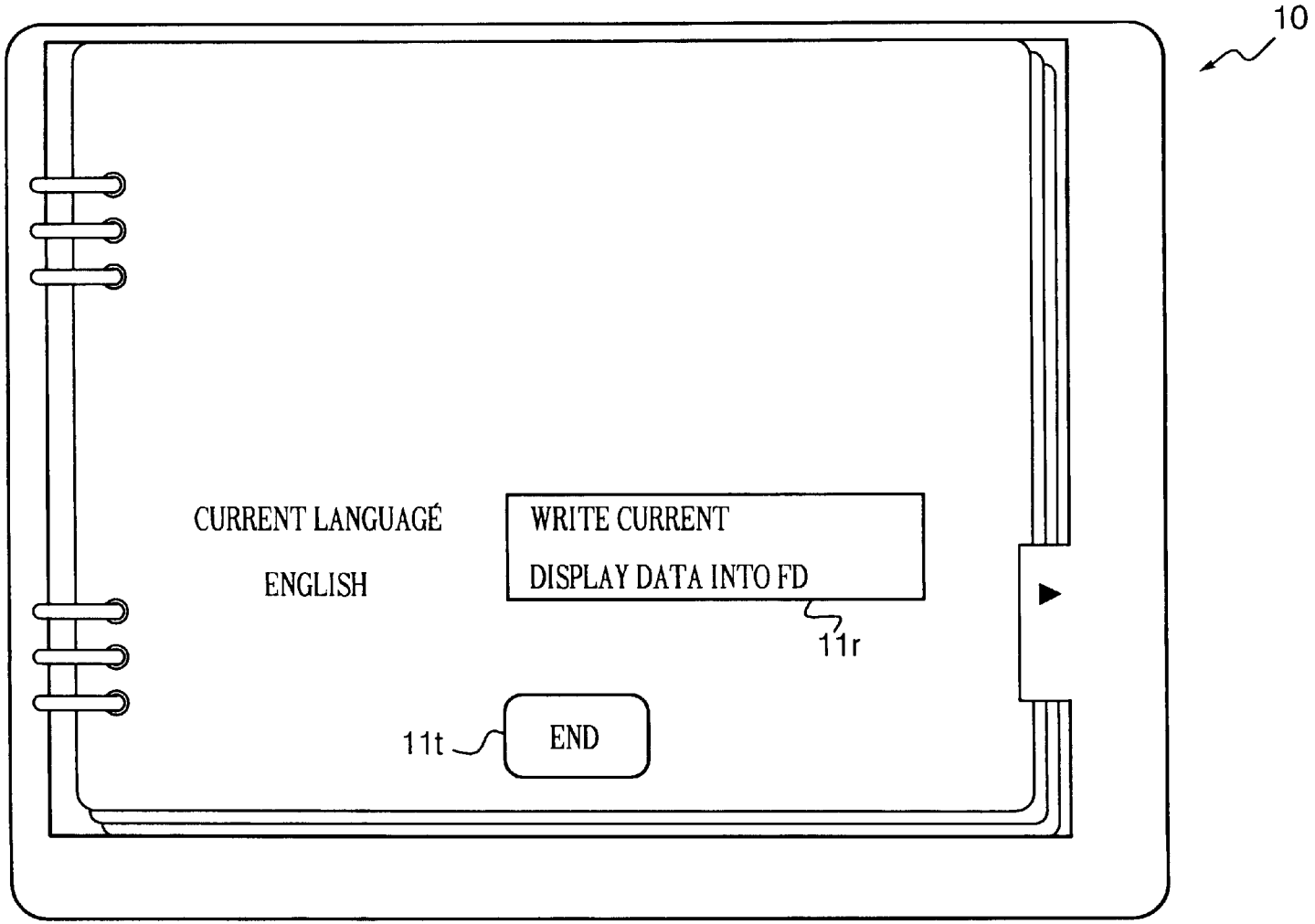
FIG. 15 shows an example of a language changing screen.

As shown in FIG. 15, the LCD 10 shows the currently set language, such as English, along with the names of function keys, such as "write current display data into FD" key 11*r* and "END" key 11*t*. Then, "1", the default value, is set to the language counter I (S44), and the number M of languages stored in the FD2 for language changing is read (S45). A language numbered I is read and displayed as a language key (S46), and if the value set in counter I is not equal to the stored language number M (S47: No), 1 is added to value of counter I (S48), and steps S46–S48 are repeatedly performed.

Figure 16:
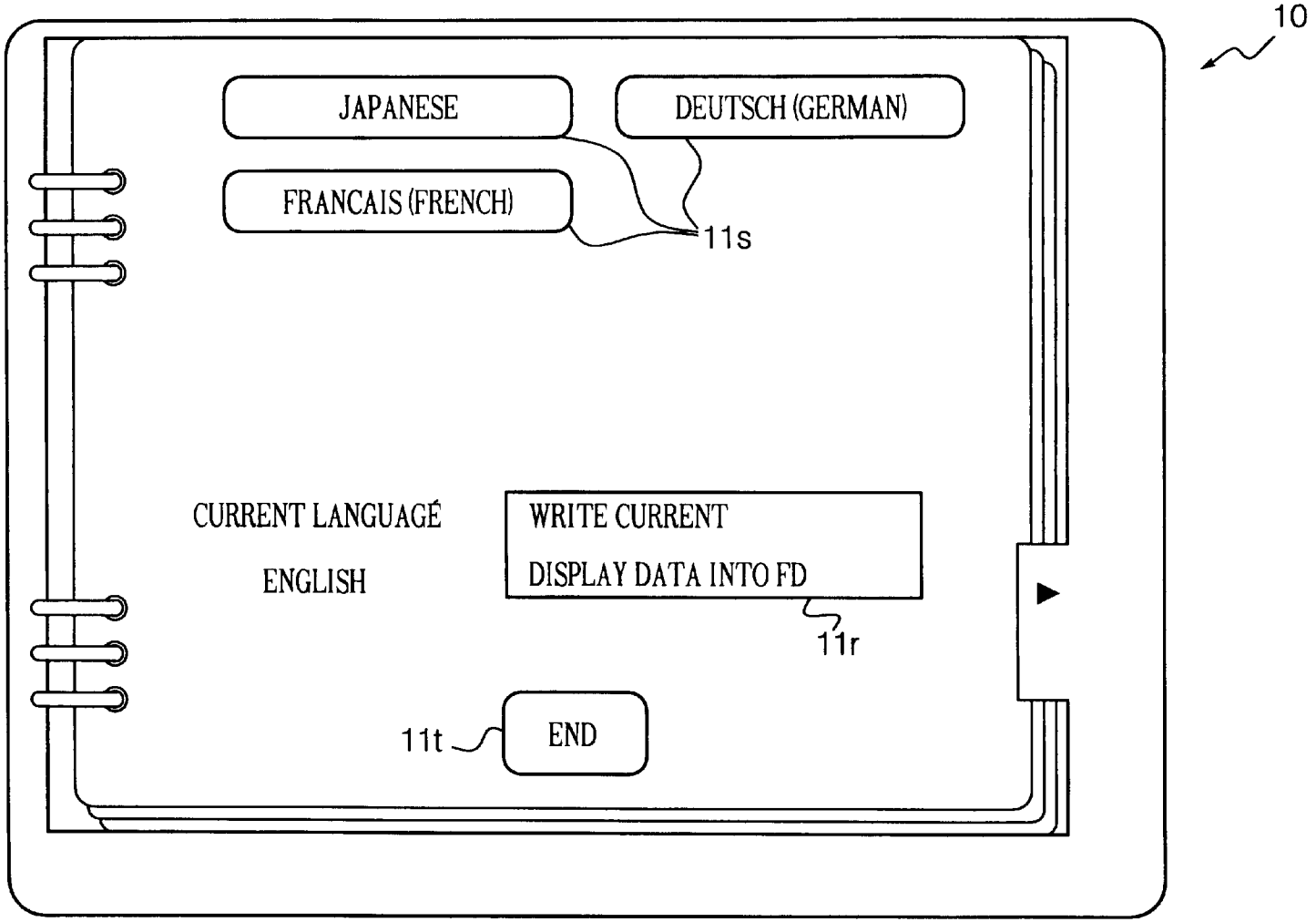
FIG. 16 corresponds to FIG. 15 when language keys are displayed.

When counter I becomes equal to the stored language number M (S47: Yes), the flow goes into a standby state for key operation (S49: No). As a result, as shown in FIG. 16, the names of the languages stored in the FD2 for language changing, Japanese, German, and French appear on the LCD 10 as language keys 11*s*. To store the display data of the currently set language, in our example, English, before changing to another language, the write key 11*r* is pressed (S50: No, S51: Yes), the warning message "Never turn off the power," blinks in red (S56), and the display data in the flash memory 25 is read and stored in the FD2 inserted into the FDD 29 (S57) thereby "backing up" the currently stored language, i.e., English.

When one of the language keys 11*s* is pressed (S50: Yes), the same warning message of step S56 blinks in red (S53), the display data of the specified language is read from the FD2 (S54), the information stored in the flash memory 25 is deleted, and the read display data is stored in the flash memory 25 (S55). When the END key 11*t* is pressed (S50 and S51: No, S52: Yes), the language changing control is finished and the flow returns to S3 in the pattern selection control.

Figure 17:
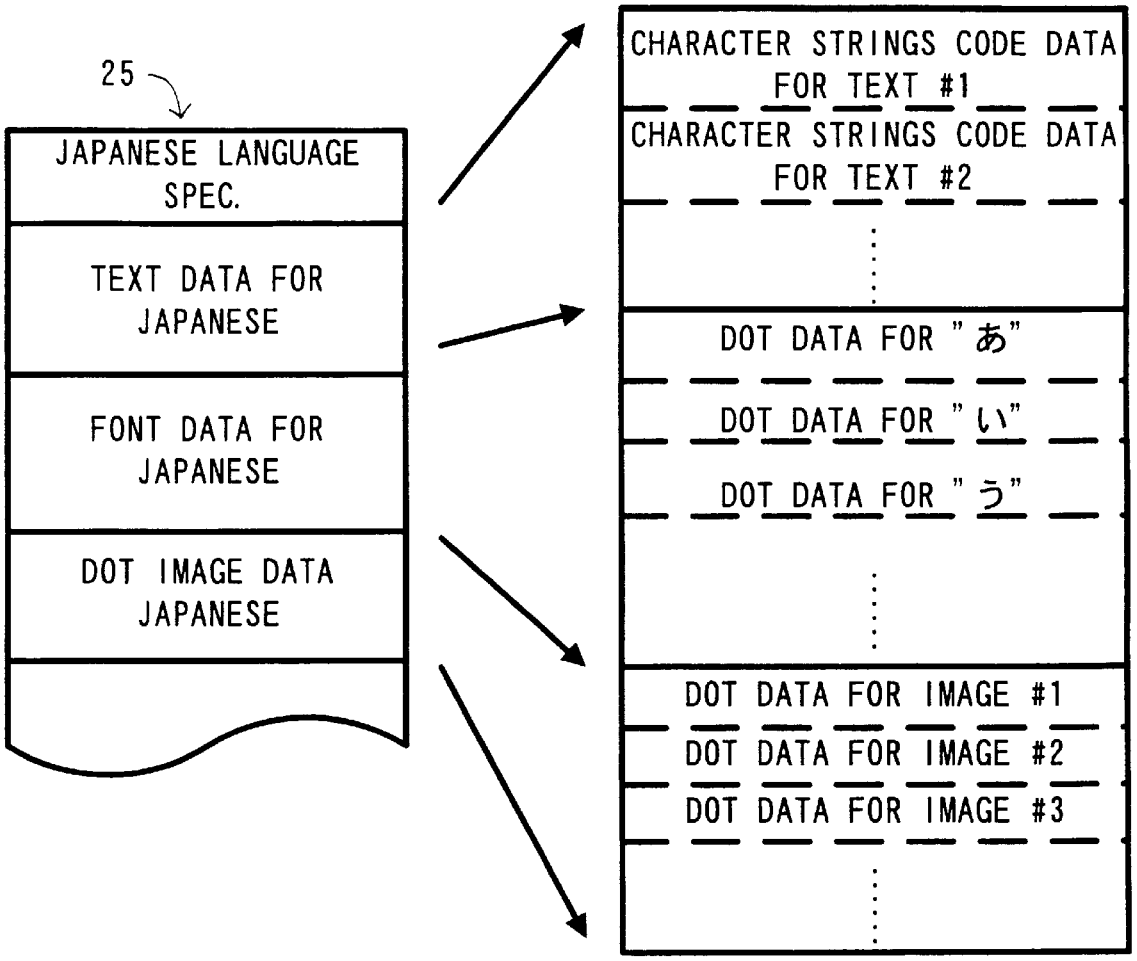
FIG. 17 corresponds to FIG. 4 and shows a structure of data stored in the flash memory that stores display data in Japanese.
Figure 18:
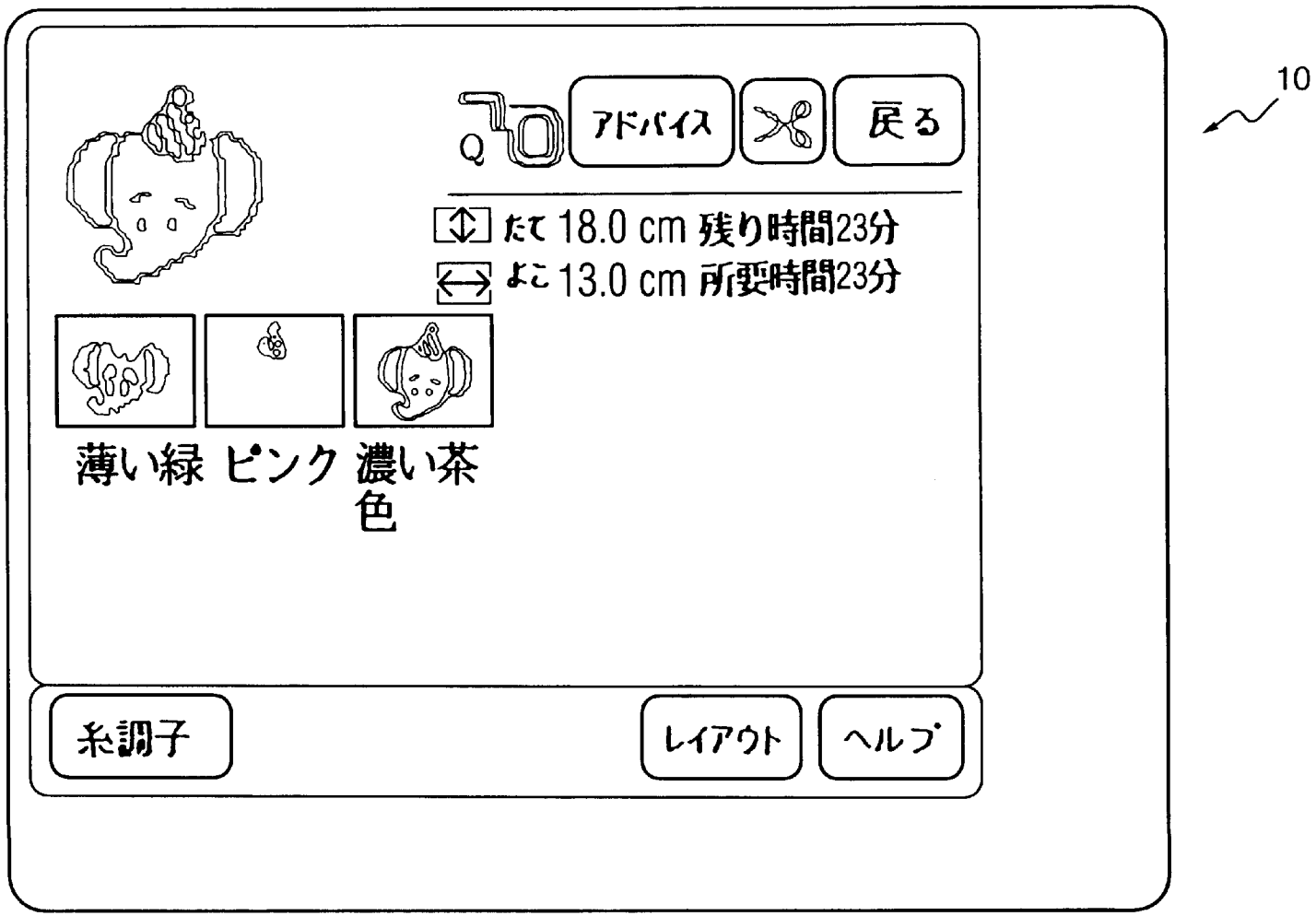
FIG. 18 corresponds to FIG. 14 except for it is indicated in Japanese.

For example, when the Japanese language key 11*s* is pressed, Japanese specification, Japanese text data, Japanese font data, and Japanese image data are rewritten in the flash memory 25 as shown in FIG. 17. Similarly, when the embroidery pattern, elephant, is selected, the Japanese display appears as shown in FIG. 18.

On the menu screen, shown in FIG. 10, when a function key except the image keys 11*f*, 11*g*, 11*h*, the FD key 11*j*, and the language change key 11*q*, is pressed (S3: Yes, S4–S6: No), the process corresponding to the function key pressed is performed (S15).

Figure 19:
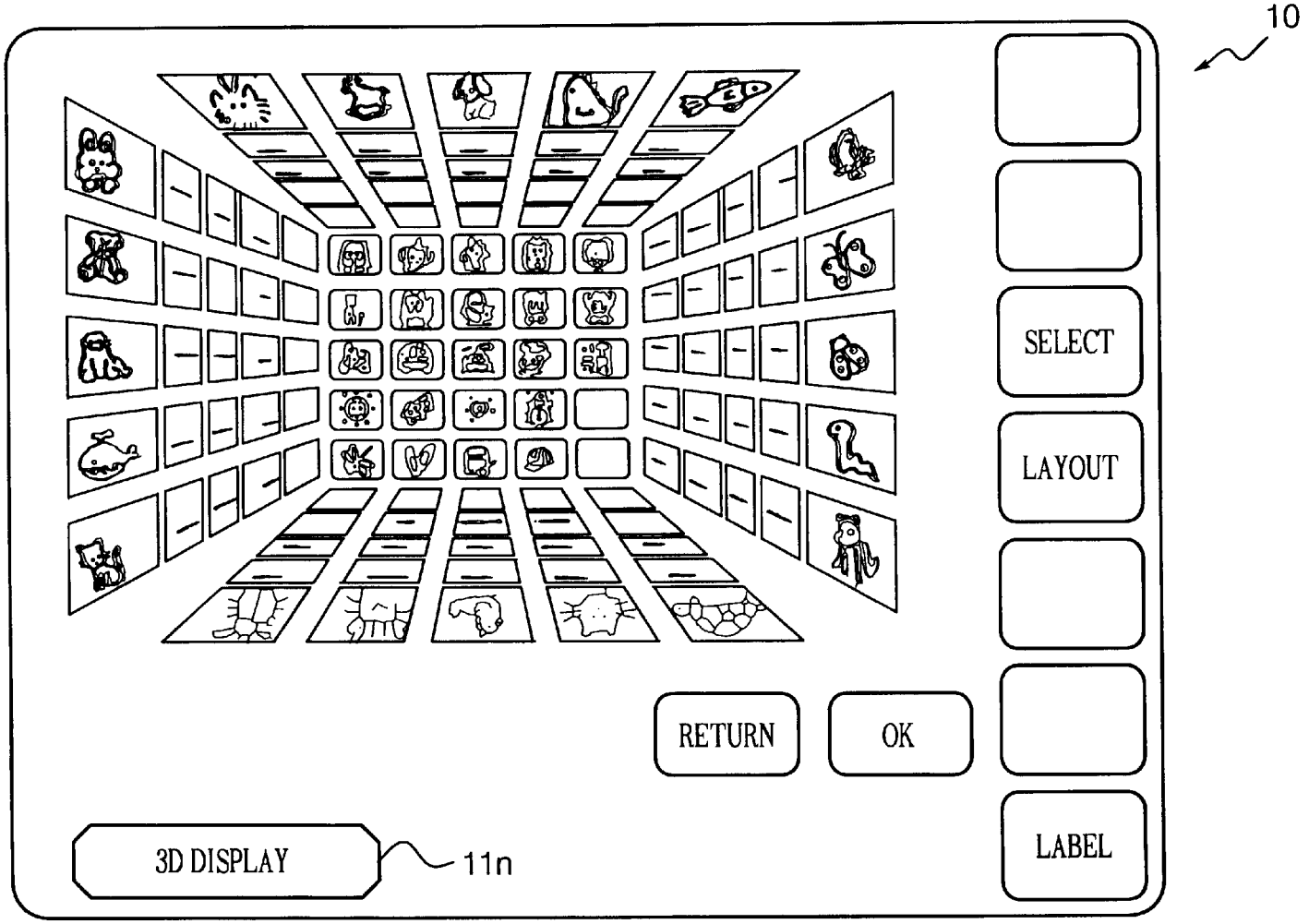
FIG. 19 shows an example of a pattern selection screen which displays five screens at a time in 3D.

When the image 3D DISPLAY key 11*u* is pressed on the LCD 10 displaying a plurality of icons, as shown in FIG. 13 (S7), the LCD 10 may show five screens, each screen displaying image icons, at a time in 3D as shown in FIG. 19.

When the interface for communications is changed to either the RS232C 31 or the USB 32 manually, the menu screen may include the RS232C key and the USB key as shown in FIG. 10.

The flash memory 25 in the controller C of the machine M stores English display data. When an action is done on the machine M, such as pressing a key and selecting a pattern, the display data including text and dot images appear in English. If the FD2 that stores language display data in Japanese, German, and French, is inserted into the FDD 29, and the Japanese language key 11*s* is pressed, the display data in English is first backed up and then Japanese is read from the FD2 and written into the flash memory 25. This means the flash memory 25 need only have a memory capacity of, e.g., about 4 megabytes that is adequate to store the display data in a single language. Compared with the case where the display data for a plurality of languages must be stored in a memory, the flash memory 25 can be miniaturized which leads to lower cost.

Since the FD2 has a volume label "LANGUAGE CHANGE" that indicates the display data already exists, an easy and quick decision can be made whether the FD2 stores the display data by judging whether volume is labeled "LANGUAGE CHANGE".

When the write key 11*r* is pressed, display data stored in the flash memory 25 is read and written into the FD2 inserted into the FDD 29. Even if the display data read from the FD2 is written into the flash memory 25, the original display data written in the FD2 can be written into the flash memory 25 over and over, which can facilitate recovery work for the display data which is developed in a different language.

A plurality of display data which can be displayed in various languages may be stored in a ROM card. The ROM card may be connected to the connector 13 exclusive for the ROM card so that display data in only one language can be read from the ROM card and written into the flash memory 25. A ROM card and/or a floppy disk may be detachably used in the sewing machine M. The sewing machine M and an external storing memory having display data developed in a plurality of languages may be connected to a communication network, such as the Internet, so that display data in the external storing memory can be read via the communication network by a reading operation at the machine M.

Instead of providing the flash memory 25 in the controller C, a ROM card exclusively for language changing may be kept inserted at all times, to read display data in a specified language from the ROM card and to indicate necessary information directly on the display. When another language is specified, information on the LCD 10 can be indicated in the specified language.

In addition to display data, control programs and/or sewing data may be read from an external storing device like a floppy disk, and written into the flash memory 25.

A modified embodiment where the control programs are read from the floppy disk and stored in the flash memory 25 will now be described in detail with reference to the accompanying drawings.

When a key to enter into the program rewriting mode (not shown) is pressed, the program rewriting process is called from S15 in the flowchart of FIG. 7, and the process shifts to the program rewriting mode.

Figure 20:
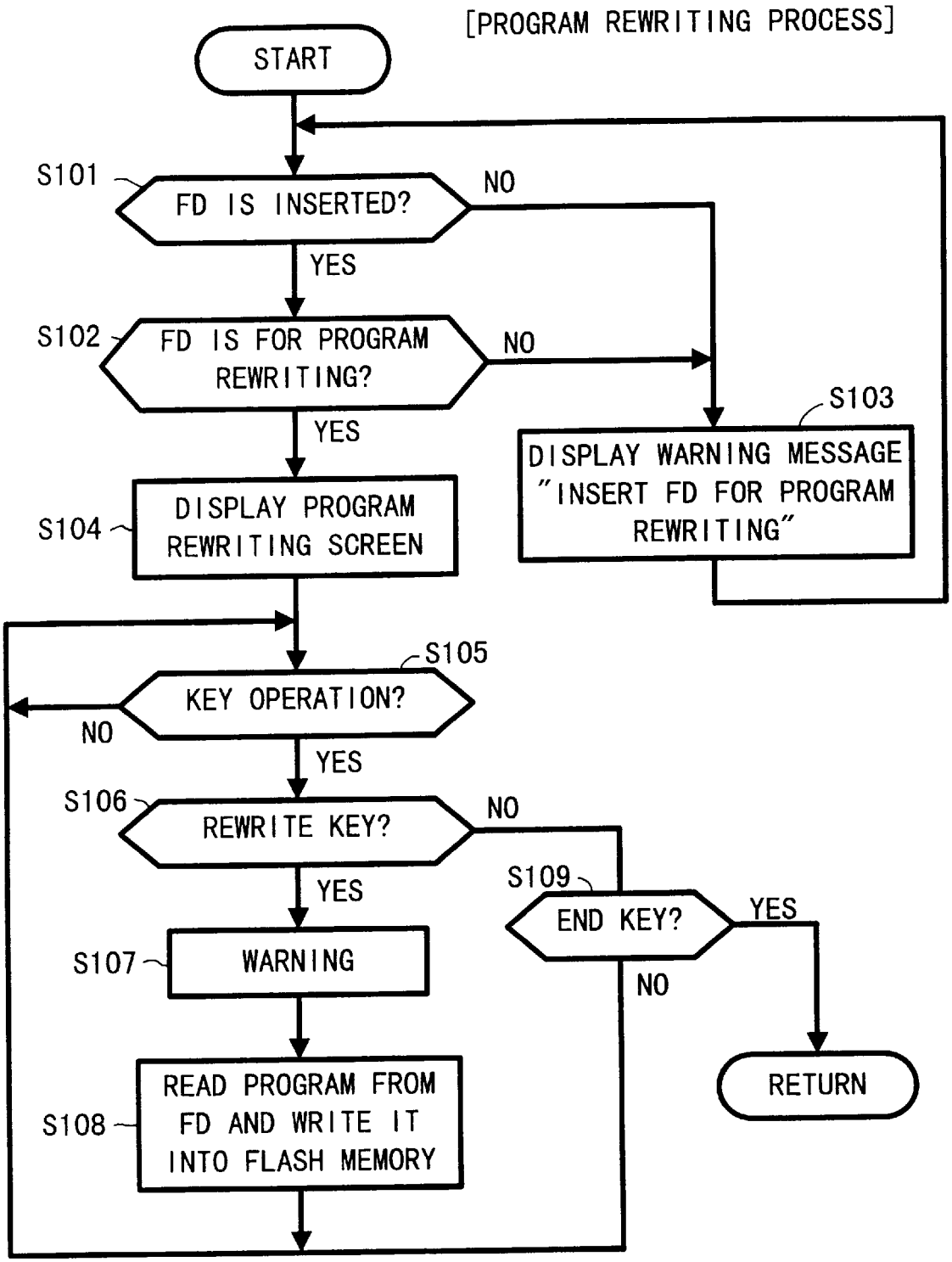
FIG. 20 is a flowchart of another embodiment.

The program rewriting process will now be described referring to the flowchart of FIG. 20.

When a floppy disk for program rewriting is inserted into the FDD 29, the CPU 22 determines that the floppy disk is inserted into the FDD 29 (S101: Yes) and that the floppy disk is for the exclusive use of program rewriting (S102: Yes). The LCD 10 displays the program rewriting screen (S104: Yes). If the floppy disk is not inserted into the FDD 29 (S101: No), or a floppy disk other than the disk exclusively for program rewriting is inserted into the FDD 29 (S102: No), a warning message, "Insert FD for program rewriting use" appears (S103).

When the program rewriting screen appears (S104), if the rewrite key (not shown) is pressed (S105: Yes, S106: Yes), a warning message indicating that the program is to be rewritten appears (S107), and a program is read from the floppy disk and written into the flash memory 25 (S108). If the END key is pressed (S106: No, S109: Yes), the program rewriting process is finished.

According to this embodiment, the control program in the flash memory 25 is rewritable without the need of a connection between a personal computer and the machine M, and the programming can be upgraded easily.

Sewing data and display data as well as program data may be read from the floppy disk and written into the flash memory 25. In this case, not only can the programs be upgraded but also sewing data can be updated and the display language can be changed, which will remarkably improve the efficiency of operation.

It should be understood that the invention is not limited in its application to the details of structure and arrangement of parts illustrated in the accompanying drawings. The invention is capable of other embodiments and of being practiced or performed in various ways without departing from the technical idea thereof, based on existing techniques and well-known techniques among those skilled in the art.

What is claimed is:

1. A sewing machine, comprising:

a display that displays information;

an obtaining device that obtains display data from outside of the sewing machine;

a determining device that determines if the display data includes language change information;

a nonvolatile storing device that stores the display data rewritably in a nonvolatile condition;

a writing device that writes display data obtained by the obtaining device into the nonvolatile storing device when the determining device determines that the display data includes language change information; and a display controller that displays information on the display based on the display data stored in the nonvolatile storing device.

2. The sewing machine according to claim 1, further comprising an external storing device that stores display data including language change information, wherein the obtaining device obtains display data from the external storing device.

3. The sewing machine according to claim 2, wherein the external storing device includes language change identification data for identifying the language change information.

4. The sewing machine according to claim 1, wherein the obtaining device obtains display data through a communication network.

5. The sewing machine according to claim 1, further comprising a selecting device that selects at least one language of the display data to be obtained by the obtaining device.

6. The sewing machine according to claim 1, wherein the display controller displays a language name for display data stored in the nonvolatile storing device.

7. The sewing machine according to claim 1, further comprising an instructing device that instructs the obtaining device to obtain display data.

8. The sewing machine according to claim 1, further comprising a transfer device that transfers the display data stored in the nonvolatile storing device to a predetermined storing device.

9. The sewing machine according to claim 8, wherein the display comprises a touch panel, and the display controller displays a key for specifying the transfer device on the touch panel.

10. The sewing machine according to claim 9, wherein the display controller displays the key for specifying the transfer device along with a language name for display data stored in the nonvolatile storing device on the touch panel.

11. The sewing machine according to claim 1, wherein the display comprises a touch panel.

12. The sewing machine according to claim 1, wherein the display controller displays at least one of a name of a thread color and a name of a stitch pattern in the language of the display data stored in the nonvolatile storing device.

13. The sewing machine according to claim 1, wherein the obtaining device further obtains sewing data, and the writing device writes the sewing data as well as the display data into the nonvolatile storing device.

14. The sewing machine according to claim 1, wherein the obtaining device further obtains a program, and the writing device writes the program as well as the display data into the nonvolatile storing device.

15. The sewing machine according to claim 1, wherein the nonvolatile storing device has a capacity to store display data for a language.

16. A sewing machine, comprising:

an obtaining device that obtains data from outside of the sewing machine;

a determining device that determines if the data is a program;

a nonvolatile storing device that stores data rewritably in a nonvolatile condition; and a writing device that writes a program obtained by the obtaining device into the nonvolatile storing device when the determining device determines that the data is a program.

17. The sewing machine according to claim 16, wherein the obtaining device further obtains sewing data, and the writing device writes the sewing data as well as the program into the nonvolatile storing device.

18. The sewing machine according to claim 16, wherein the obtaining device further obtains language information, and the writing device further writes the language information into the nonvolatile storing device.

19. A sewing machine, comprising:

a non-volatile memory for storing operating data in a first language;

means for obtaining data from an external source;

a display that displays menu screens, sewing data, operating instructions and other appropriate messages for an operator;

discriminating means for determining whether the data of the external source is one of program data, sewing data, and language data; and a writing device for writing a second language into the non-volatile memory.

20. The sewing machine according to claim 19, further comprising:

means for rewriting the first language to a storage medium; and means for deleting the first language from the non-volatile memory prior to writing the second language therein.

* * * * *